US011833444B2

(12) United States Patent
Landau

(10) Patent No.: US 11,833,444 B2
(45) Date of Patent: Dec. 5, 2023

(54) MODULAR TOY CONSTRUCTION SYSTEM

(71) Applicant: Shmuel Landau, Mazkeret Batya (IL)

(72) Inventor: Shmuel Landau, Mazkeret Batya (IL)

(73) Assignee: Shmuel Landau, Mazkeret Batya (IL)

( * ) Notice: Subject to any disclaimer, the term of this patent is extended or adjusted under 35 U.S.C. 154(b) by 0 days.

(21) Appl. No.: 18/023,986

(22) PCT Filed: Aug. 17, 2021

(86) PCT No.: PCT/IL2021/051001
§ 371 (c)(1),
(2) Date: Feb. 28, 2023

(87) PCT Pub. No.: WO2022/043989
PCT Pub. Date: Mar. 3, 2022

(65) Prior Publication Data

US 2023/0241526 A1 Aug. 3, 2023

Related U.S. Application Data

(60) Provisional application No. 63/072,254, filed on Aug. 31, 2020.

(51) Int. Cl.
*A63H 33/08* (2006.01)

(52) U.S. Cl.
CPC ..... *A63H 33/084* (2013.01); *A63H 33/088* (2013.01)

(58) Field of Classification Search
CPC .... A63H 33/08; A63H 33/084; A63H 33/088; A63H 33/108; A63H 33/12
(Continued)

(56) References Cited

U.S. PATENT DOCUMENTS 811,158 A * 1/1906 Maddux ..... B65D 5/48038 217/31
1,288,226 A * 12/1918 Schrader ..... A63H 33/105 446/122

(Continued)

FOREIGN PATENT DOCUMENTS

CN 2238073 10/1996
CN 201988185 9/2011

(Continued)

OTHER PUBLICATIONS

International Search Report and Written Opinion dated Nov. 3, 2021 in PCT International Patent Application No. PCT/IL2021/051001.

(Continued)

*Primary Examiner* — Joseph B Baldori
(74) *Attorney, Agent, or Firm* — Snell & Wilmer L.L.P.

(57) ABSTRACT

A construction toy system including a plurality of modular assembly pieces and a plurality of pivotal-rods. Each of the pivotal-rods includes an identical engaging rod-tips on each end thereof. Each of the assembly pieces have identical thickness and a circumferential edge. A number of straight receiving grooves are formed, inwardly, at the circumferential edge, wherein the identical thickness is predesigned to fittingly fill the gap formed by the straight receiving groove. A select assembly piece is configured to interlock with another assembly piece via the straight receiving grooves of both selected assembly pieces. A selected assembly pieces may have at least one identical circular through hole formed at a central location with respect to the lateral dimension of the assembly pieces, wherein an engaging rod-tip of a selected pivotal-rod may engage with a selected circular through hole of the selected assembly piece.

16 Claims, 18 Drawing Sheets

(58) Field of Classification Search
USPC ..... 446/107, 108, 109, 111, 113, 114, 116, 446/122, 124, 125, 127
See application file for complete search history.

(56) References Cited

U.S. PATENT DOCUMENTS 1,311,337 A * 7/1919 Fredson ..... A63H 33/06 446/114
1,574,191 A * 2/1926 Groves ..... A63H 33/06 446/106
2,104,742 A * 1/1938 Fleischer ..... A63H 33/06 446/106
2,414,716 A * 1/1947 Carson ..... A63H 33/105 446/124
2,446,120 A * 7/1948 Wiswesser ..... A63H 33/06 273/156
2,633,662 A * 4/1953 Nelson ..... A63H 33/06 446/116
2,751,706 A * 6/1956 Metal ..... A63H 33/06 211/186
2,844,910 A * 7/1958 Korchak ..... A63H 33/06 446/85
2,874,512 A * 2/1959 Joseph ..... A63H 33/084 446/106
2,984,935 A * 5/1961 Beck ..... A63H 33/06 446/114
3,066,436 A * 12/1962 Schuh ..... A63H 33/06 428/542.2
3,177,611 A * 4/1965 Beck ..... A63H 33/06 446/114
3,537,706 A * 11/1970 Heavener, Jr. ..... A63H 33/06 273/459
3,564,758 A * 2/1971 Willis ..... A63H 33/06 446/116
3,570,169 A * 3/1971 Jacob ..... A63H 33/06 446/124
3,698,124 A * 10/1972 Reitzel ..... A63H 33/06 428/542.2
3,855,748 A * 12/1974 Thomas ..... A63B 9/00 52/578
3,940,100 A * 2/1976 Haug ..... A47B 3/00 D21/489
4,065,220 A * 12/1977 Ruga ..... E04B 1/1903 403/176
4,107,869 A * 8/1978 Abrams ..... A63H 33/044 446/110
4,118,887 A * 10/1978 Appleman ..... A63H 33/06 446/124
4,789,370 A * 12/1988 Ellefson ..... F16B 2/22 446/116
4,819,402 A * 4/1989 Schneider ..... A63H 33/108 52/655.1
5,163,862 A * 11/1992 Philips ..... A63H 33/06 446/114
5,281,181 A * 1/1994 McCollum ..... A63H 33/044 446/124
5,372,450 A * 12/1994 Blodgett ..... A63H 33/10 D8/382
5,580,294 A * 12/1996 Briant ..... A63H 33/044 446/110
5,593,337 A * 1/1997 Lapointe ..... A63H 33/084 446/487
5,628,666 A * 5/1997 Tomczyk ..... A63H 33/08 446/125
5,707,268 A * 1/1998 Outman ..... A63H 33/10 446/104
5,788,555 A * 8/1998 Glynn ..... A63H 33/10 446/124
5,827,104 A * 10/1998 Zheng ..... A63H 33/084 446/114
5,833,511 A * 11/1998 Outman ..... A63H 33/10 446/104
5,833,512 A * 11/1998 Nicola ..... A63H 33/08 446/116
6,149,487 A * 11/2000 Peng ..... A63H 33/08 446/256
6,626,732 B1 * 9/2003 Chung ..... A63H 3/52 446/268
6,845,871 B1 * 1/2005 Culp ..... A47B 47/042 211/186
7,318,764 B2 * 1/2008 Elias ..... B44C 5/00 446/120
8,621,739 B1 * 1/2014 Elliot ..... A63H 33/084 29/428
8,832,917 B1 * 9/2014 Elliott ..... A47C 4/021 403/345
9,458,872 B2 * 10/2016 Nelson ..... F16B 7/00
10,130,893 B2 * 11/2018 Heston ..... A63H 33/084
10,272,322 B2 * 4/2019 Kim ..... A63F 3/00697
10,926,185 B1 * 2/2021 Pihl ..... A63H 17/002
11,123,650 B2 * 9/2021 Hart ..... A63H 33/082
2006/0284372 A1 * 12/2006 Matilla ..... A63F 3/00006 446/124
2008/0032586 A1 * 2/2008 Dyer ..... A63H 33/08 446/85
2009/0029625 A1 * 1/2009 Mayor ..... A63H 33/084 446/106
2010/0323580 A1 * 12/2010 Mayor ..... A63H 33/084 446/106
2014/0220853 A1 * 8/2014 Draghicescu ..... A63H 33/08 446/108
2015/0099417 A1 * 4/2015 Draghicescu ..... A63H 33/084 446/108
2016/0303487 A1 * 10/2016 Ayers ..... A63H 33/084
2016/0317939 A1 * 11/2016 Fernandez ..... A63H 33/084
2017/0312646 A1 * 11/2017 Chiu ..... A63H 33/084
2019/0344188 A1 * 11/2019 Gutierrez ..... A63H 33/084

FOREIGN PATENT DOCUMENTS

| | | |
|---|---|---|
| CN | 211215431 | 8/2020 |
| EP | 2193830 | 6/2010 |
| GB | 658015 | 10/1951 |
| GB | 1596349 | 8/1981 |

OTHER PUBLICATIONS

International Preliminary Report on Patentability dated Jul. 25, 2022 in PCT International Patent Application No. PCT/IL2021/051001.

* cited by examiner 100
100a
100b
100c
100d
100e
100f
100g
101a
101b
102
103
104
105
106
107
108
110
112
113
t

MODULAR TOY CONSTRUCTION SYSTEM

CROSS REFERENCE TO RELATED APPLICATIONS

This application is a U.S. National Stage Entry under 35 U.S.C. § 371 of International Application No. PCT/IL2021/051001 filed Aug. 17, 2021 entitled "MODULAR TOY CONSTRUCTION SYSTEM," which claims priority to and the benefit of U.S. Provisional Patent Application Ser. No. 63/072,254 filed on Aug. 31, 2020. The contents of each application are incorporated herein by reference in their entireties.

FIELD OF THE INVENTION

The present invention relates to parts for constructing real or imaginary objects and more particularly, to parts (pieces) which can be assembled together and combined with each other so as to construct existing or imaginary structure forms.

BACKGROUND OF THE INVENTION AND PRIOR ART

There are many different types of building sets currently on the market including, but not limited to LEGO®, Tinker Toys® and K'NEXO. LEGO® uses interlocking bricks that can be used to form a vast range of real or imaginary objects in a manner which more or less corresponds to a desired form. Both the Tinker Toys® and K'NEXO systems tend to be hub based, which have hubs that are interconnected with struts to form structures.

What is needed is a new and unique building set that gives children additional ways in which to be creative, including the ability to use objects and materials that children already have for incorporation within the creations they make. It would be further advantageous to be able to form a vast number of real or imaginary structures, wherein at least some portions of the structure can be moved and continuously change the structure form. The present invention solves these needs, among other abilities.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present disclosure provides an improved set of construction toy assembly pieces having a number of different structural interlocking pieces that are configured for snapping together to thereby form two-dimensional or three-dimensional structures. The construction toy pieces have one or more connecting grooves, slots and or holes formed in predesigned location that are configured for interlocking with other construction pieces. The pieces are made of strong and resilient materials.

The toy construction set of the present disclosure includes a plurality of game assembly pieces in various shapes and preconfigured thickness. Embodiments, however, are not limited to the disclosed set of game assembly pieces, and may encompass other shapes that fall within the spirit and scope of the principles of this disclosure. Each game assembly piece may be provided with a color and may be composed of any suitable material that will fall within the spirit and scope of the principles of this disclosure.

According to teachings of the present disclosure there is provided a construction toy system including a plurality of modular assembly pieces and a plurality of pivotal-rods. Each of the pivotal-rods includes an elongated cylindrically shaped central member and including identical engaging rod-tips on each end thereof. Each of the assembly pieces have identical thickness and a circumferential edge.

A number of straight receiving grooves are formed, inwardly, at the circumferential edge, and wherein the identical thickness is predesigned to fittingly fill the gap formed by the straight receiving groove, wherein a select assembly piece of the plurality of assembly pieces is configured to interlock with another assembly piece via respectively selected straight receiving grooves of both selected assembly pieces.

The circumferential edge may be straight, round or a combination thereof.

A round edge may be a circular edge.

Preferably, an elongated edge includes two elongated parallel edge segments.

Preferably, the assembly pieces have at least one identical circular through hole that is formed at a central location with respect to the lateral dimension of the assembly pieces, wherein a selected pivotal-rod of the pivotal-rods is configured to interlock with a selected assembly piece by engaging a selected engaging rod-tip of the select pivotal-rod with a selected circular through hole of the selected assembly piece.

Optionally, the at least one of the assembly pieces has at least one identical cylindrical peg that is protruding form that at least one assembly piece, and wherein the cylindrical peg is configured to interlock with a selected circular through hole of another selected assembly piece.

Optionally, at least one of the assembly pieces has at least one identical cylindrical peg that is protruding form the at least one assembly piece, and wherein the cylindrical peg is configured to interlock with a selected pivotal-rod by engaging the peg of the pivotal-rod with a cavity of the selected pivotal-rod.

Preferably, the plurality of modular assembly pieces are predesigned to have a proportional symmetry therebetween the assembly pieces, wherein the lengths of the respective assembly pieces is either the same or multiplied by an integer.

Preferably, the plurality of modular assembly pieces are predesigned to have a proportional symmetry therebetween the assembly pieces, wherein the lengths of the respective assembly pieces is either the same or multiplied by an integer.

Preferably, the plurality of modular assembly pieces are predesigned to have a proportional symmetry therebetween the assembly pieces, wherein the lengths of the respective assembly pieces is either the same or multiplied by an integer. It should be appreciated that the proportional symmetry therebetween the distance between adjacent the circular through holes, provides the construction toy system with the required modularity.

Preferably, the plurality of modular assembly pieces are predesigned to have a proportional symmetry therebetween the distance between adjacent the circular through holes formed in the respective assembly pieces is either the same or multiplied by an integer.

Optionally, selected pivotal-rod of the pivotal-rods is configured to interlock with another pivotal-rod by engaging a selected engaging rod-tip of the selected pivotal-rod engaging with a cavity of the other pivotal-rod.

Optionally, the plurality of modular assembly pieces are selected from a group of assembly pieces including a flat-stick piece, a connector-pieces, a flat wheel piece, a flat U-shaped piece, a narrow upright U-shaped piece, a wide upright U-shaped piece, a flat L-shaped piece, a flat traversed-Z-shaped piece, an upright T-shaped piece, a flat bow-shaped piece, an upright bow-shaped piece, a flat ring-shaped piece, a flat oval-shaped piece, an upright ring-shaped piece and an upright oval-shaped piece.

BRIEF DESCRIPTION OF THE DRAWINGS

FIG. 5*b* further illustrates that an engaging rod-tip of an example pivotal-rod piece as in FIG. 5*a*, may be inserted into a respective cavity.

FIGS. 21*a*-20*c* illustrate another example embodiment of another example structure having moving parts, in three different positions.

DETAILED DESCRIPTION OF THE PREFERRED EMBODIMENTS

Figures 1A, 1B, 1C, 1D, 1E, 1F, 1G:
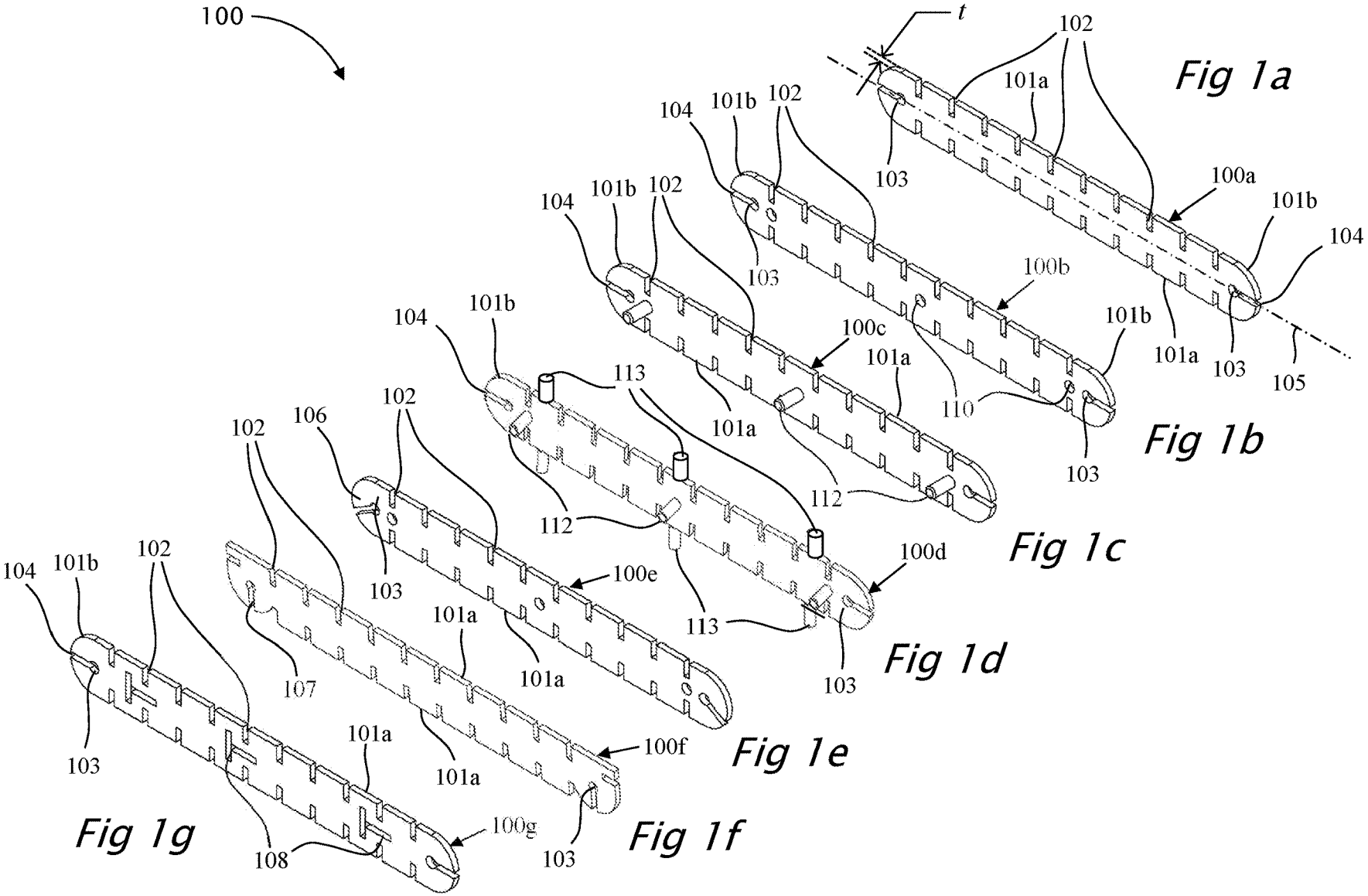
FIG. 1*a* is a perspective view of an example embodiment of a first basic flat-stick piece, according to variations of the present disclosure.
FIG. 1*b* is a perspective view of an example embodiment of a second basic flat-stick piece, according to variations of the present disclosure.
FIG. 1*c* is a perspective view of an example embodiment of a third basic flat-stick piece, according to variations of the present disclosure.
FIG. 1*d* is a perspective view of an example embodiment of a fourth basic flat-stick piece, according to variations of the present disclosure.
FIG. 1*e* is a perspective view of an example embodiment of a fifth basic flat-stick piece, according to variations of the present disclosure.
FIG. 1*f* is a perspective view of an example embodiment of a sixth basic flat-stick piece, according to variations of the present disclosure.
FIG. 1*g* is a perspective view of an example embodiment of a seventh basic flat-stick piece, according to variations of the present disclosure.

The present invention will now be described more fully hereinafter with reference to the accompanying drawings, in which preferred embodiments of the invention are shown. It should be appreciated however, that the disclosed set of modular game assembly pieces is not limited to the set shown herein, and may encompass other shapes that fall within the spirit and scope of the principles of this disclosure. Each game assembly piece may be provided with a color and may be composed of any suitable material that will fall within the spirit and scope of the principles of this disclosure.

The toy construction set of the present disclosure includes a plurality of modular game assembly pieces in various shapes and a preconfigured identical thickness. Embodiments, however, are not limited to the disclosed set of game assembly pieces, and may encompass other shapes that fall within the spirit and scope of the principles of this disclosure. Each game assembly piece may be provided with a color and may be composed of any suitable material that will fall within the spirit and scope of the principles of this disclosure.

Each game assembly piece of the toy construction set includes at least one element that facilitates that assembly piece to interact/interlock with at least one other game assembly piece. Furthermore, each game assembly piece has a preconfigured identical thickness (t, see FIG. 1*a*). It should be appreciated the thickness of an assembly piece may vary at location that do not interact with any other assembly piece.

Reference is now made to the drawings. FIGS. 1*a*-1*f* show a perspective view of sample example embodiments of a basic flat-stick piece type 100, according to variations of the present disclosure. Each basic flat-stick piece 100 includes a pair of elongated flat faces, preferably parallel, having a longitudinal axis 105. A basic flat-stick piece type 100 includes two straight elongated parallel edges 101*a* and a two round edges 101*b* at each end of basic flat-stick piece type 100, wherein the straight elongated parallel edges 101*a* and the two round edges 101*b* form a circumferential edge 101. A number of straight receiving grooves 102 are formed, inwardly, at the straight elongated parallel edges 101*a*. The receiving grooves 102 are typically, with no limitation, equally spaced apart. The width of each receiving groove 102 is preconfigured to receive other game assembly pieces, wherein the width of each receiving groove 102 is preconfigured to fittingly receive the thickness dimension (t) of the received game assembly piece. The number of straight receiving grooves 102 formed on each side may vary.

Typically, a circular through hole is formed at the center of the round end edges 101*b* of the basic flat-stick piece type 100, wherein a straight end groove is formed at a preconfigured location of the round edge and extends through the hole formed at the center of the respective round edge.

FIG. 1*a* is a perspective view of an example embodiment of a first basic flat-stick piece 100*a*, wherein the straight end groove 104 is formed along the longitudinal axis 105 and ends with a circular through hole 103. FIG. 1*b* is a perspective view of an example embodiment of a second basic flat-stick piece 100*b*, that is similar to a first basic flat-stick piece 100*a*, but has additional one or more circular through holes 110 that are formed along the longitudinal axis 105. FIG. 1*c* is a perspective view of an example embodiment of a third basic flat-stick piece 100*c*, that is similar to first basic flat-stick piece 100*a*, but has additional one or more cylindrical pegs 112 that are protruding perpendicular to one of the two faces of third basic flat-stick piece 100*c*, along the longitudinal axis 105. Each cylindrical peg 112 is configured to be fittingly inserted into circular through holes 110. FIG. 1*d* is a perspective view of an example embodiment of a fourth basic flat-stick piece 100*d*, that is similar to third basic flat-stick piece 100*c* including cylindrical pegs 112, but has additional one or more cylindrical pegs 113 that are protruding perpendicularly away from one both straight elongated parallel edges 101*a* of fourth basic flat-stick piece 100*d*, perpendicular to the longitudinal axis 105. Each cylindrical peg 113 is configured to be fittingly inserted into circular through holes 110.

FIG. 1*e* is a perspective view of an example embodiment of a fifth basic flat-stick piece 100*e*, that is similar to second basic flat-stick piece 100*b*, but the straight end groove 106 is formed at an angle off the longitudinal axis 105 and ends with a circular through hole 103. FIG. 1*f* is a perspective view of an example embodiment of a sixth basic flat-stick piece 100*f*, but the straight end groove 107 is formed perpendicular to the longitudinal axis 105 and ends with a circular through hole 103. FIG. 1*g* is a perspective view of an example embodiment of a seventh basic flat-stick piece 100*g*, that is similar to first basic flat-stick piece 100*b*, but instead of additional one or more circular through holes 110 laying T-shaped through openings 108 are formed along the longitudinal axis 105.

Figures 2A, 2B, 2C, 2D, 2E:
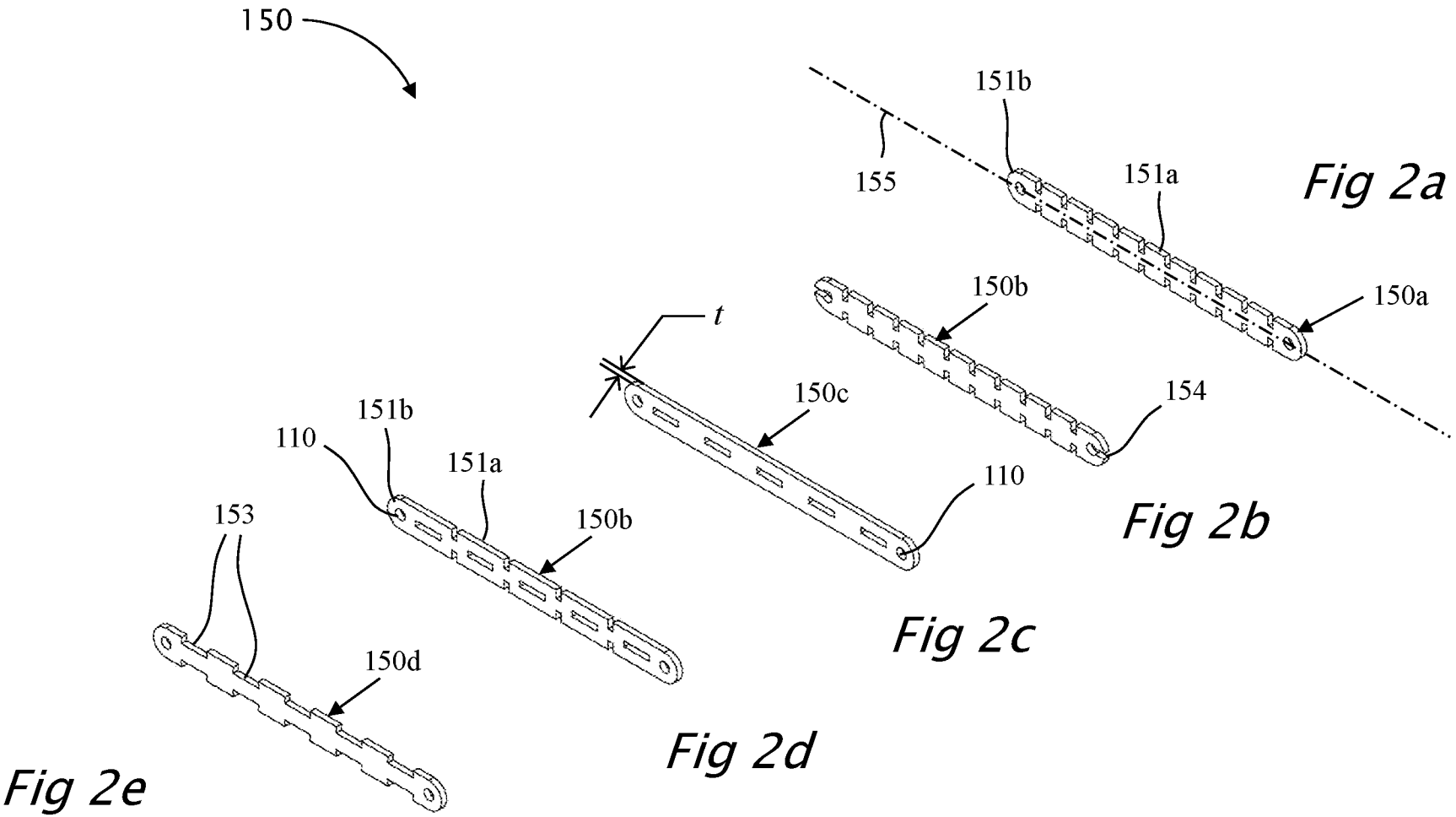
FIG. 2*a* is a perspective view of an example embodiment of a first narrow flat-stick piece, according to variations of the present disclosure.
FIG. 2*b* is a perspective view of an example embodiment of a second narrow flat-stick piece, according to variations of the present disclosure.
FIG. 2*c* is a perspective view of an example embodiment of a third narrow flat-stick piece, according to variations of the present disclosure.
FIG. 2*d* is a perspective view of an example embodiment of a fourth narrow flat-stick piece, according to variations of the present disclosure.
FIG. 2*e* is a perspective view of an example embodiment of a fifth narrow flat-stick piece, according to variations of the present disclosure.

FIGS. 2*a*-1*e* show a perspective view of sample example embodiments of a narrow flat-stick piece type 150, according to variations of the present disclosure. Typically, with no limitations, the length of a narrow flat-stick piece type 150 is half the length of a basic flat-stick piece type 100.

Each narrow flat-stick piece 150 includes a pair of elongated flat faces having a longitudinal axis 155. A narrow flat-stick piece 150 includes two straight elongated parallel edges 151*a* and two round edges 151*b* at each end of narrow flat-stick piece type 150, wherein the straight elongated parallel edges 151*a* and the two round edges 151*b* form a circumferential edge 151. A number of straight receiving grooves 102 may be formed, inwardly, at the straight elongated parallel edges 151*a*. The receiving grooves 102 are typically, with no limitation, equally spaced apart.

Typically, a circular through hole 110 is formed at the center of the round edges 151*b* of the narrow flat-stick piece type 150, wherein a straight end groove may be formed at a preconfigured location of the round edge 151*b* and through the hole formed at the center of the respective round edge 151*b*.

FIG. 2*a* is a perspective view of an example embodiment of a first narrow flat-stick piece 150*a*, wherein a number of straight receiving grooves 102 are formed, inwardly, at the straight elongated parallel edges 151*a*. FIG. 2*b* is a perspective view of an example embodiment of a second narrow flat-stick piece 150*b*, that is similar to first narrow flat-stick piece 150*a*, wherein the straight end groove 154 is formed at a preconfigured location of the round edge and extends along the longitudinal axis 155 and through a circular hole formed at the center of the respective round edge. FIG. 2*c* is a perspective view of an example embodiment of a third narrow flat-stick piece 150*b*, that has no straight receiving grooves 102, but has slots formed along the longitudinal axis 155. FIG. 2*d* is a perspective view of an example embodiment of a fourth narrow flat-stick piece 150*c*, that is similar to first narrow flat-stick piece 150*c*, but also has straight receiving grooves 102. FIG. 2*e* is a perspective view of an example embodiment of a fifth narrow flat-stick piece 150*d*, but the straight receiving grooves 102 are replaced by wide receiving grooves.

Figure 3D:
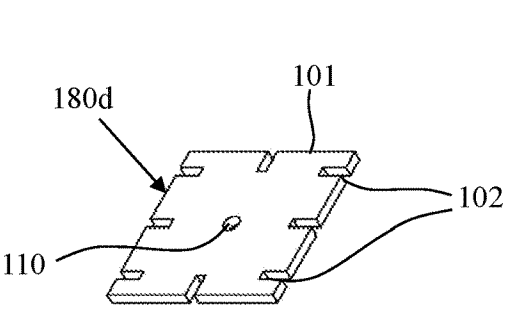
FIGS. 3*a*-3*d* are perspective view illustrations of perspective view of example embodiments of connector-pieces, according to variations of the present disclosure.
Figure 3C:
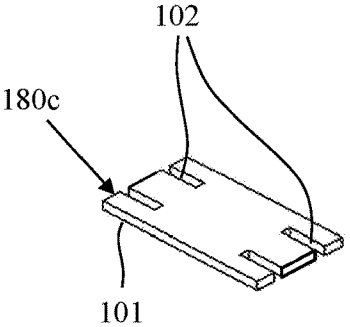
Figure 3B:
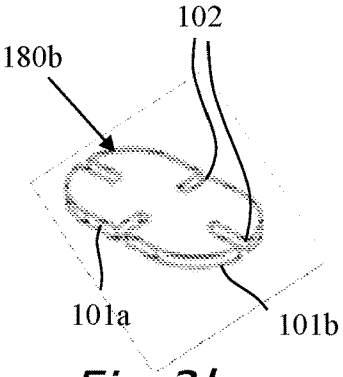
Figure 3A:
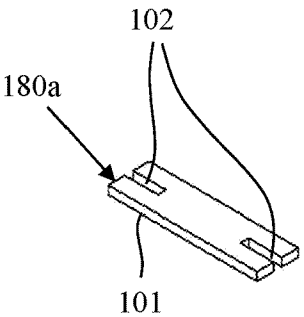

FIGS. 3*a*-3*d* are perspective view illustrations of non-limiting examples of connector-pieces 180 configured to interconnect two or more game assembly pieces. FIG. 3*a* illustrates of perspective view of example embodiments of connector-piece 180*a* that includes two straight receiving grooves 102 and thus, can connect only two game assembly pieces. FIG. 3*b* illustrates of perspective view of example embodiments of connector-piece 180*b* that includes four straight receiving grooves 102, one on each side of connector-piece 180*b*, wherein all four corners are rounded. FIG. 3*c* illustrates of perspective view of example embodiments of connector-piece 180*c* that includes four straight receiving grooves 102 and thus, can connect up to four game assembly pieces. FIG. 3*d* illustrates of perspective view of example embodiments of connector-piece 180*d* that includes eight straight receiving grooves 102 and a hole 110 and thus, can connect more game assembly pieces.

FIGS. 4*a*-4*e* are perspective view illustrations of non-limiting examples of a variety of wheels 200 configured to allow relative rotational motion. Preferably, the thickness of wheels 200 is also t. typically, all wheels 200 have a number of straight receiving grooves 102 are formed, inwardly, at the circular edge 201 of respective wheels.

Figure 4A:
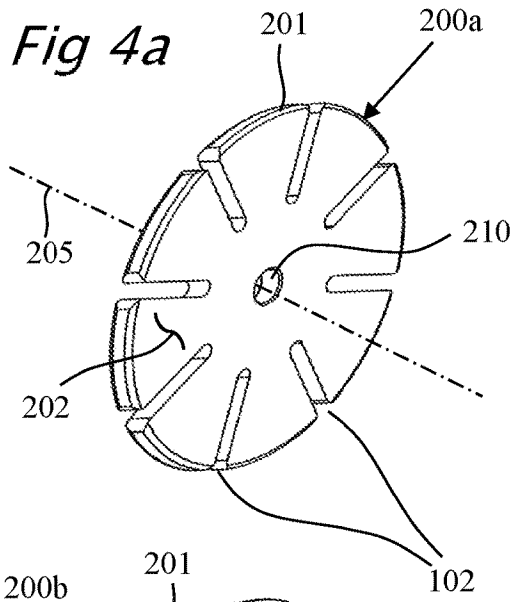
FIG. 4*a* is a perspective view illustration of an example flat wheel piece, having a hole formed at the center and configured to receive a matching pivotal-rod, according to variations of the present disclosure.

FIG. 4*a* is a perspective view illustration of an example flat wheel piece 200*a*, having a hole 210 formed at the center of the wheel and configured to receive a matching peg 112 or pivotal-rod, according to variations of the present disclosure. Typically, flat wheel piece 200*a* includes a pair of circular flat faces 202, preferably parallel to each other, and having a longitudinal axis 505. A flat wheel piece 200*a* includes circular circumferential edge 201 wherein a number of straight receiving grooves 102 are formed, inwardly, at the circular circumferential edge 201. A circular through hole 110 is formed at the center of flat wheel piece 200*a* at the longitudinal axis 205.

Figure 4B:
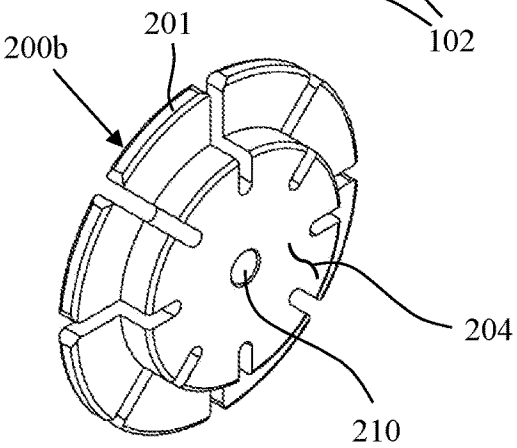
FIG. 4*b* is a perspective view illustration of an example wheel piece, having a flat face on a first side and a terraced face on the second side, and having a hole formed at the center and configured to receive a matching pivotal-rod, according to variations of the present disclosure.

FIG. 4*b* is a perspective view illustration of an example wheel piece 200*b* is similar to flat wheel piece 200*a* except that it has a thicker center section forming a terraced face 204 on one side of wheel piece 200*b*, for strength.

Figure 4D:
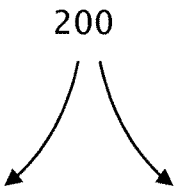
FIG. 4*d* is a perspective view illustration of an example flat wheel piece, having a connecting pin protruding from center of one face perpendicular thereto, according to variations of the present disclosure, wherein the end of the connecting pin is split into two or more sections.
Figure 4D:
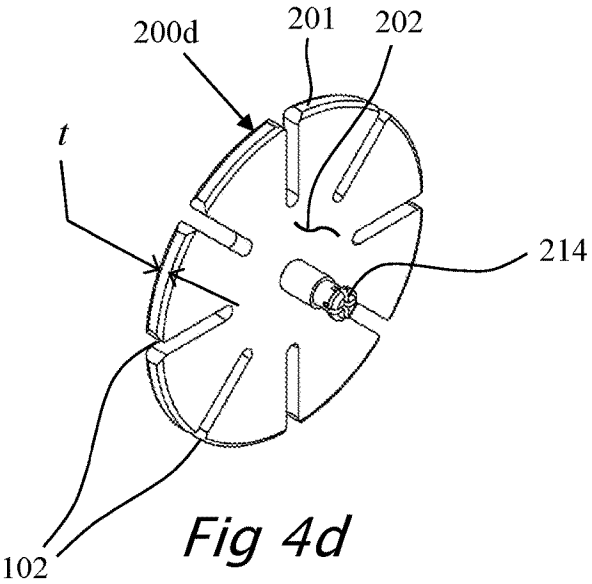
Figure 4C:
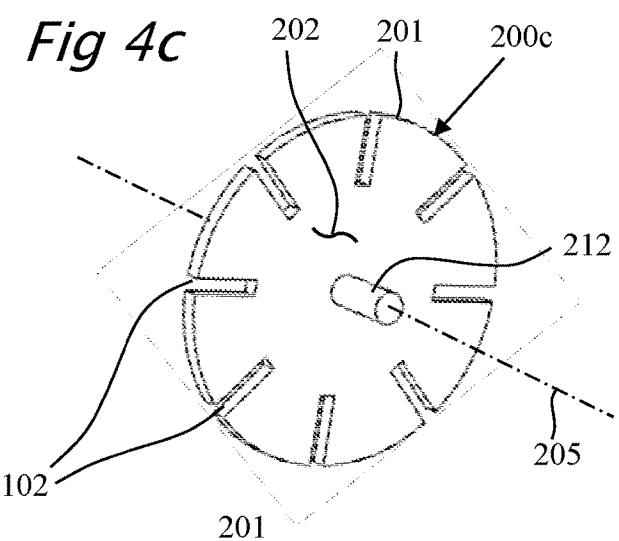
FIG. 4*c* is a perspective view illustration of an example flat wheel piece, having a connecting peg protruding from center of one face perpendicular thereto, according to variations of the present disclosure.

FIG. 4*c* is a perspective view illustration of an example flat wheel piece 200*c* is similar to flat wheel piece 200*a*, but instead of a cylindrical hole 210 it has a cylindrical peg 212 protruding at the center of the wheel, outwardly, perpendicular to one of the two faces 202 of flat wheel piece 200*c*, along the longitudinal axis 205.

FIG. 4*d* is a perspective view illustration of an example flat wheel piece 200*d*, having a connecting split peg 214 that is split at least into two parts (4 parts in the non-limiting example shown in FIG. 4*d*) and protruding outwardly from the center of one of the two faces 202, perpendicular thereto, according to variations of the present disclosure, wherein the end of the connecting pin is split into two or more sections. It should be appreciated that pegs 212 and 214 can be inserted through any of the holes 110 or 210, whereas split peg 214 interlocks when inserted through a hole 110 or 210.

Figure 4E:
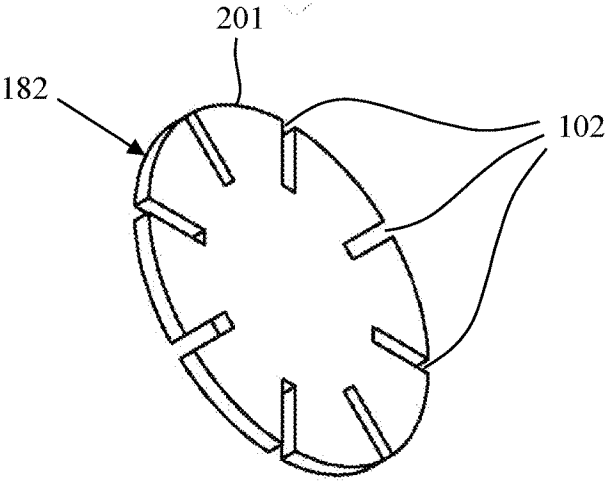
FIG. 4*e* is a perspective view illustration of an example flat disc piece, according to variations of the present disclosure.

FIG. 4*e* is a perspective view illustration of an example flat circular disc piece 182, according to variations of the present disclosure, that can be used as a connecting piece.

Figure 5A:
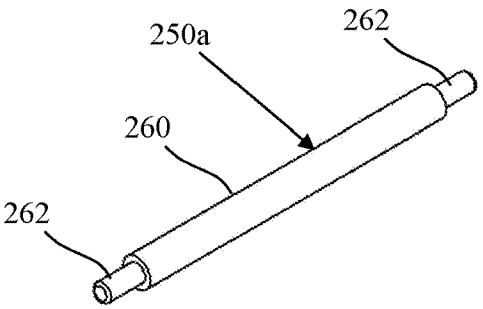
FIG. 5*a* is a perspective view of an example embodiment of a pivotal-rod piece, according to variations of the present disclosure.
Figure 5B:
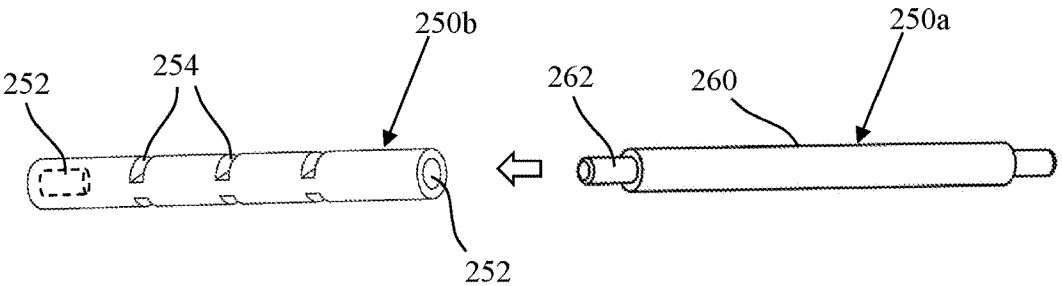
FIG. 5*b* is a perspective view of an example pivotal-rod piece as having two cylindrical cavities formed at two ends of the elongated cylindrical body.
Figure 5C:
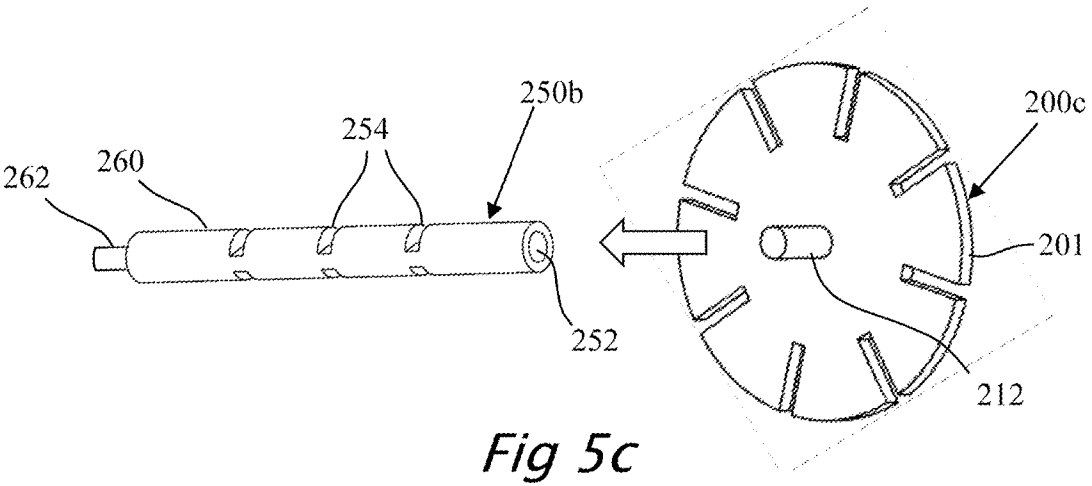
FIG. 5*c* is a perspective view of an example pivotal-rod piece as in FIG. 5*b*, wherein a cylindrical peg of flat wheel piece as shown in the example flat wheel piece shown in FIG. 4*c*, may be inserted into a respective cavity of pivotal-rod piece.

FIGS. 5*a*-5*c* are perspective view illustrations of non-limiting examples of pivotal-rod pieces 250 that may also fittingly interconnect two game assembly pieces that have corresponding circular holes formed therein. Typically, pivotal-rod pieces 250 have an elongated cylindrical body 260, and may be provided with a variety of lengths. The engaging rod-tips 262 of the pivotal-rod pieces 250 are cylindrical and configured to be inserted into a hole such as holes 110 and 210, wherein the respective engaging rod-tip 262 is either fittingly inserted into a respective hole 110, or rotatably inserted into a respective hole 110 or 210, such that rotational motion can be formed between the pivotal-rod piece 250 and the game assembly piece in which the corresponding respective hole 110 or 210 is formed.

Figure 5D:
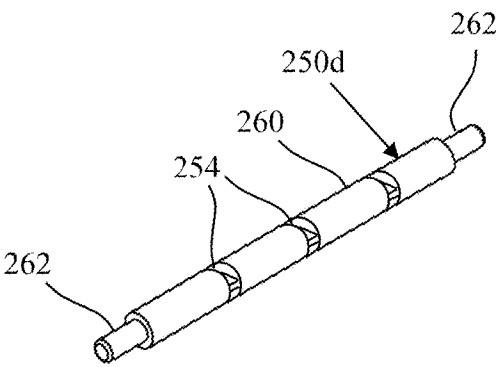
FIG. 5*d* is a perspective view of an example pivotal-rod piece as in FIG. 5*a*, wherein pairs of lateral groves are formed in the cylindrical body of the pivotal-rod piece.
Figure 5E:
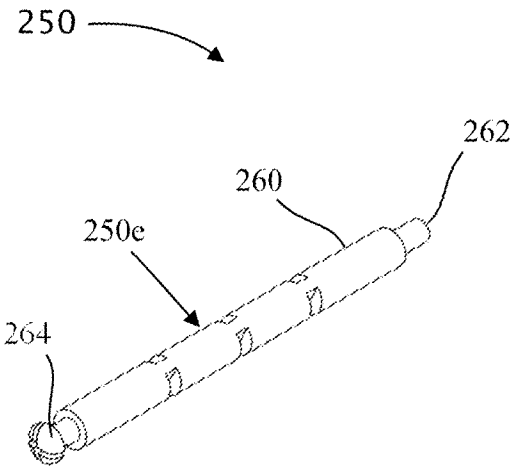
FIG. 5*e* is a perspective view of an example pivotal-rod piece as in FIG. 5*a*, wherein one connecting peg is a split connecting peg.

FIG. 5*a* is an example of pivotal-rod piece 250*a* has two engaging rod-tips 262, extending away from the elongated cylindrical body 260, and that are used similarly to the usage of pegs 112. FIG. 5*b* is an example of pivotal-rod piece 250*b* having two cylindrical cavities 252 formed at two ends of the elongated cylindrical body 260 wherein cylindrical cavities 252 are configured to receive either a fitted peg such as cylindrical pegs 112 or 212, or an engaging rod-tip 262. Example pivotal-rod piece 250*b* may further have pairs of lateral groves 254 formed in the cylindrical body 260, wherein each pair of lateral groves 254 is configured receive another game assembly piece. It should be appreciated that such pairs of lateral groves 254 may be formed in any type of pivotal-rod piece 250 having an elongated cylindrical body 260, as shown in FIGS. 5*d* and 5*e* with regards to pivotal-rod piece 250*d* and 250*e*, respectively. FIG. 5*b* further illustrates that an engaging rod-tip 262 of pivotal-rod piece 250*a* may be inserted into a cavity 252 pivotal-rod piece 250*b*. similarly, FIG. 5*c* further illustrate that a cylindrical peg 212 of flat wheel piece 200*c* may be inserted into a cavity 252 of pivotal-rod piece 250*b*.

FIG. 5*e* further illustrates that an engaging rod-tip 264, which illustrate a split connecting peg 264 that is split into at least two parts (4 parts in the non-limiting example shown in FIG. 5*e*), and facilitates an interlock connection with other game assembly pieces, for example, with a flat wheel piece 200*a*.

Figure 6:
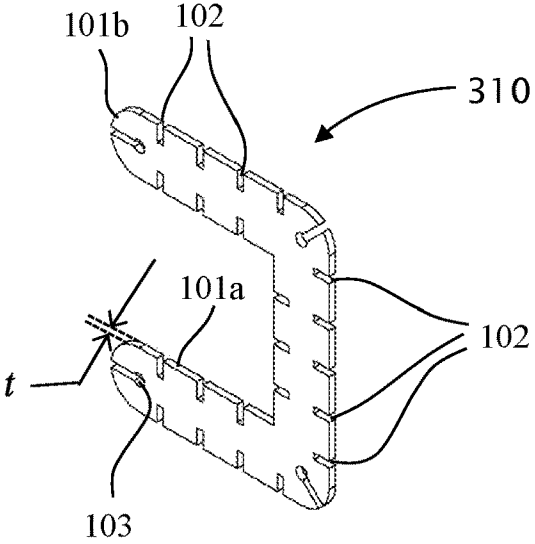
FIG. 6 is a perspective view illustration of an example flat U-shaped piece, according to variations of the present disclosure.

FIG. 6 is a perspective view illustration of an example flat U-shaped piece 310, according to variations of the present disclosure.

Figure 7A:
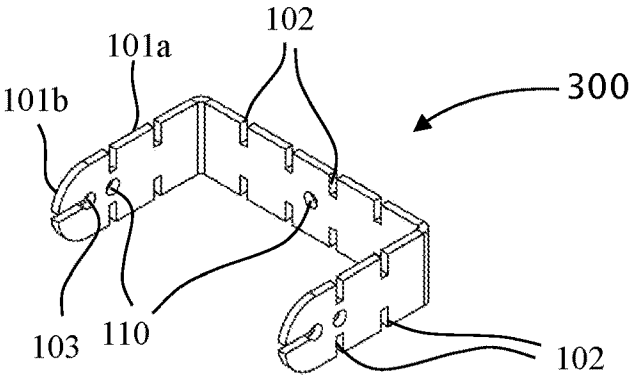
FIG. 7*a* is a perspective view illustration of an example narrow upright U-shaped piece, according to variations of the present disclosure.

FIG. 7*a* is a perspective view illustration of an example narrow upright U-shaped piece 300, according to variations of the present disclosure.

Figure 7B:
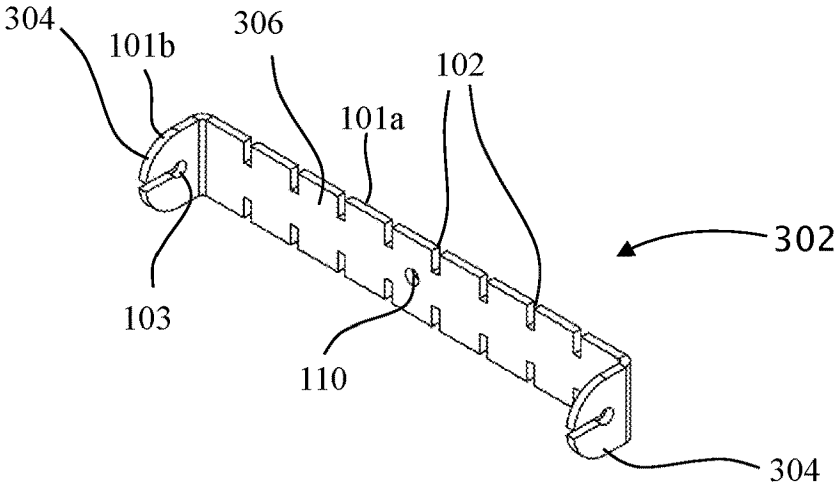
FIG. 7*b* is a perspective view illustration of an example wide upright U-shaped piece, according to variations of the present disclosure, having an elongated middle section and short arms.

FIG. 7*b* is a perspective view illustration of an example wide upright U-shaped piece 302, according to variations of the present disclosure, having an elongated middle section 306 and short arms 304.

Figure 8:
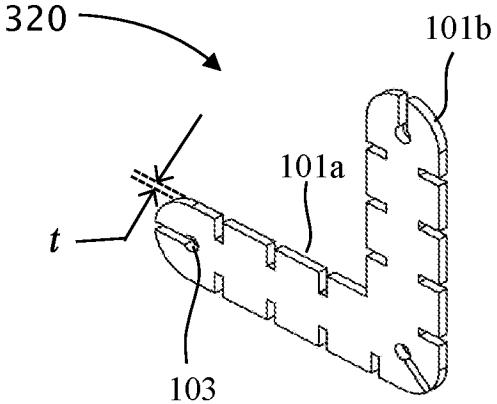
FIG. 8 is a perspective view illustration of an example flat L-shaped piece, according to variations of the present disclosure.

FIG. 8 is a perspective view illustration of an example flat L-shaped piece 320, according to variations of the present disclosure.

Figure 9:
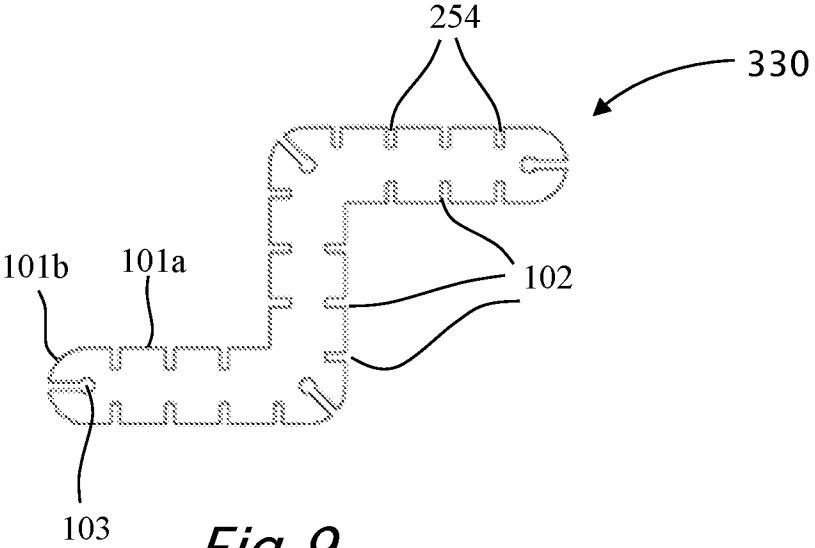
FIG. 9 is a perspective view illustration of an example flat traversed-Z-shaped piece, according to variations of the present disclosure.

FIG. 9 is a perspective view illustration of an example flat traversed-Z-shaped piece 330, according to variations of the present disclosure.

Figure 10:
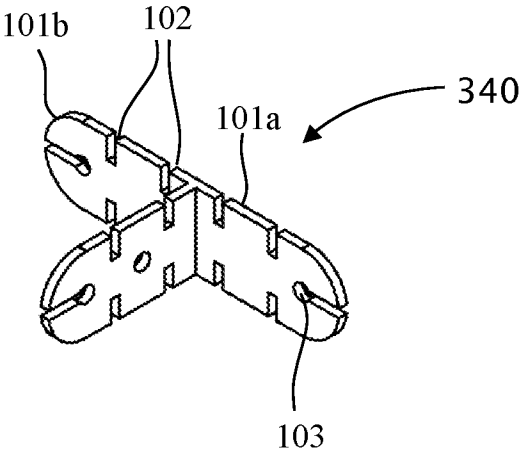
FIG. 10 is a perspective view illustration of an example upright T-shaped piece, according to variations of the present disclosure.

FIG. 10 is a perspective view illustration of an example upright T-shaped piece 340, according to variations of the present disclosure.

Figure 11A:
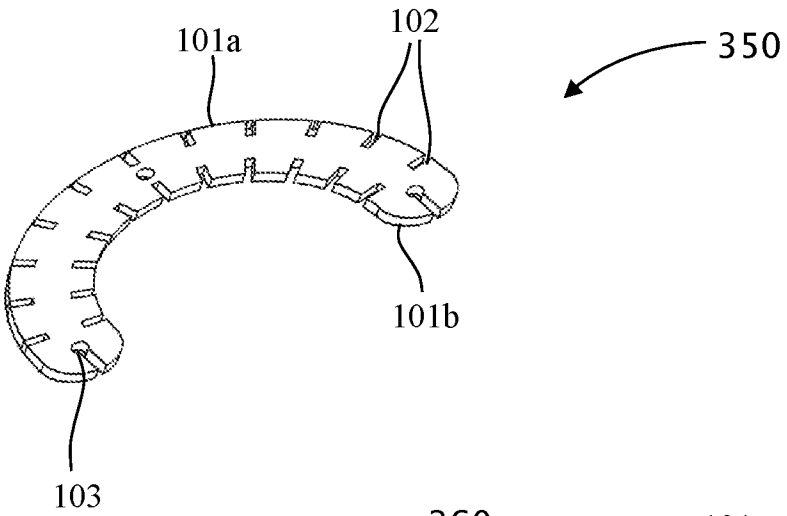
FIG. 11*a* is a perspective view illustration of an example flat bow-shaped piece, according to variations of the present disclosure.

FIG. 11*a* is a perspective view illustration of an example flat bow-shaped piece 350, according to variations of the present disclosure.

Figure 11B:
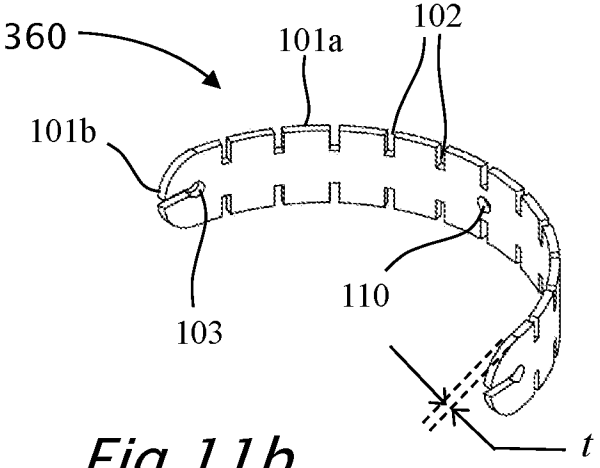
FIG. 11*b* is a perspective view illustration of an example upright bow-shaped piece, according to variations of the present disclosure.

FIG. 11*b* is a perspective view illustration of an example upright bow-shaped piece 360, according to variations of the present disclosure.

Figure 11C:
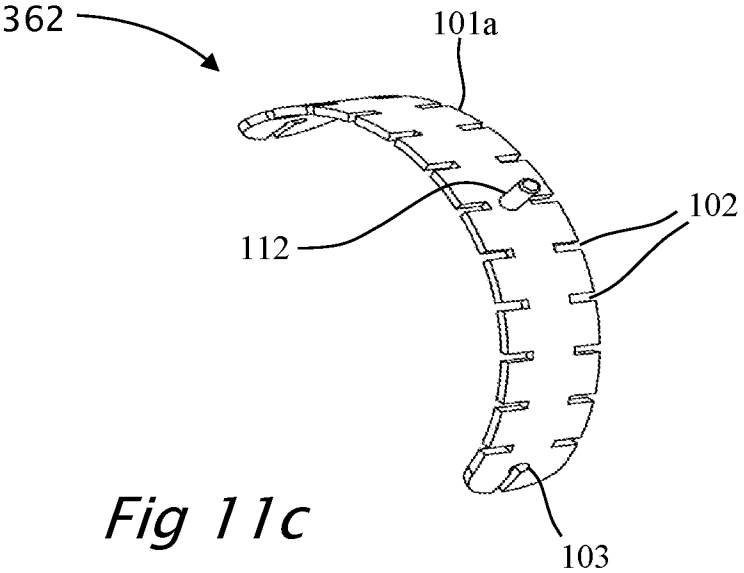
FIG. 11*c* is a perspective view illustration of an example upright bow-shaped piece, according to variations of the present disclosure, having at least one connecting pin.

FIG. 11*c* is a perspective view illustration of an example upright bow-shaped piece 362, according to variations of the present disclosure, having at least one connecting pin.

Figure 11E:
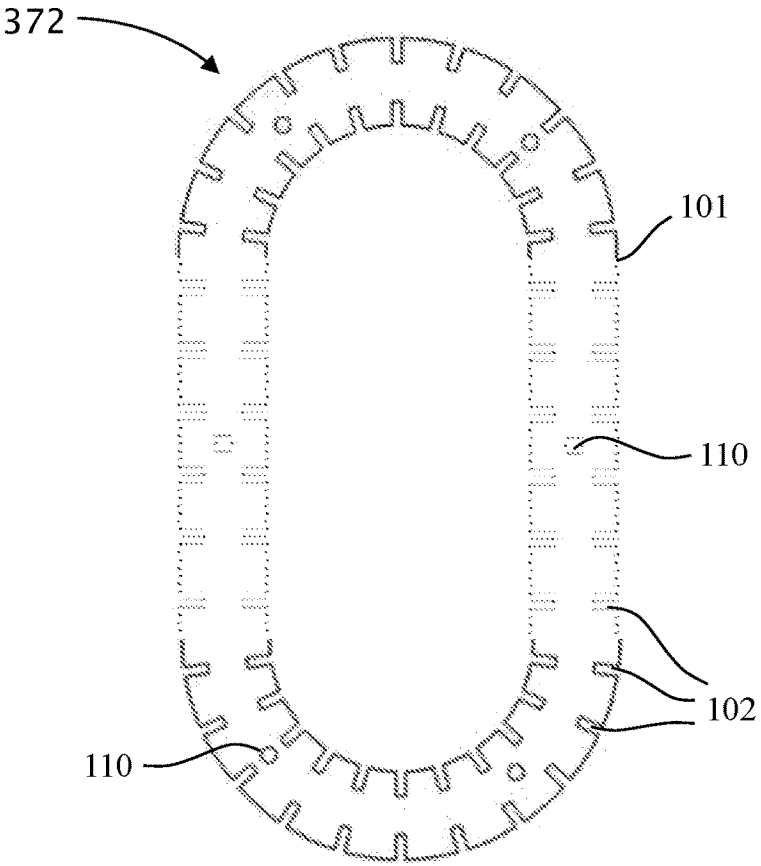
FIG. 11*e* is a perspective view illustration of an example flat oval-shaped piece, according to variations of the present disclosure.
Figure 11D:
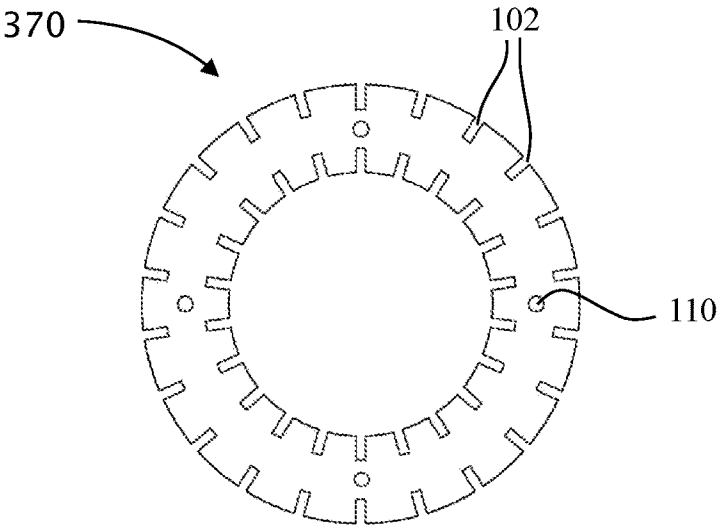
FIG. 11*d* is a perspective view illustration of an example flat ring-shaped piece, according to variations of the present disclosure.

FIG. 11*d* is a perspective view illustration of an example flat ring-shaped piece 370, according to variations of the present disclosure. It should be appreciated that a ring-shaped piece may also have an upright form, similar to upright bow-shaped piece 360, shown in FIG. 11*b*.

FIG. 11*e* is a perspective view illustration of an example flat oval-shaped piece 372, according to variations of the present disclosure. It should be appreciated that an oval-shaped piece may also have an upright form, similar to upright bow-shaped piece 360, shown in FIG. 11*b*.

Figure 12A:
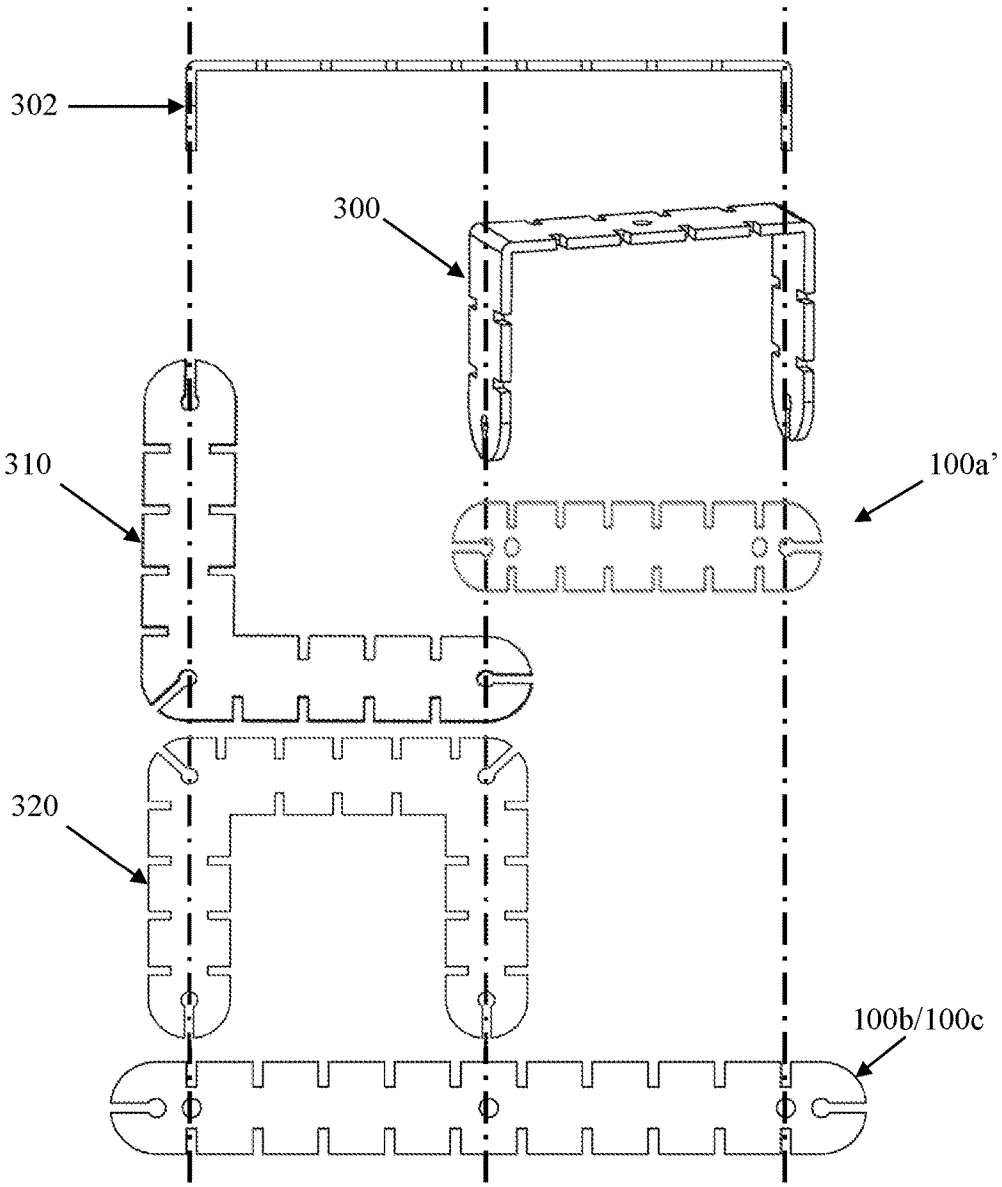
FIGS. 12*a* and 12*b* illustrate preferred proportional symmetry among members of non-limiting example groups of selected assembly pieces.
Figure 12B:
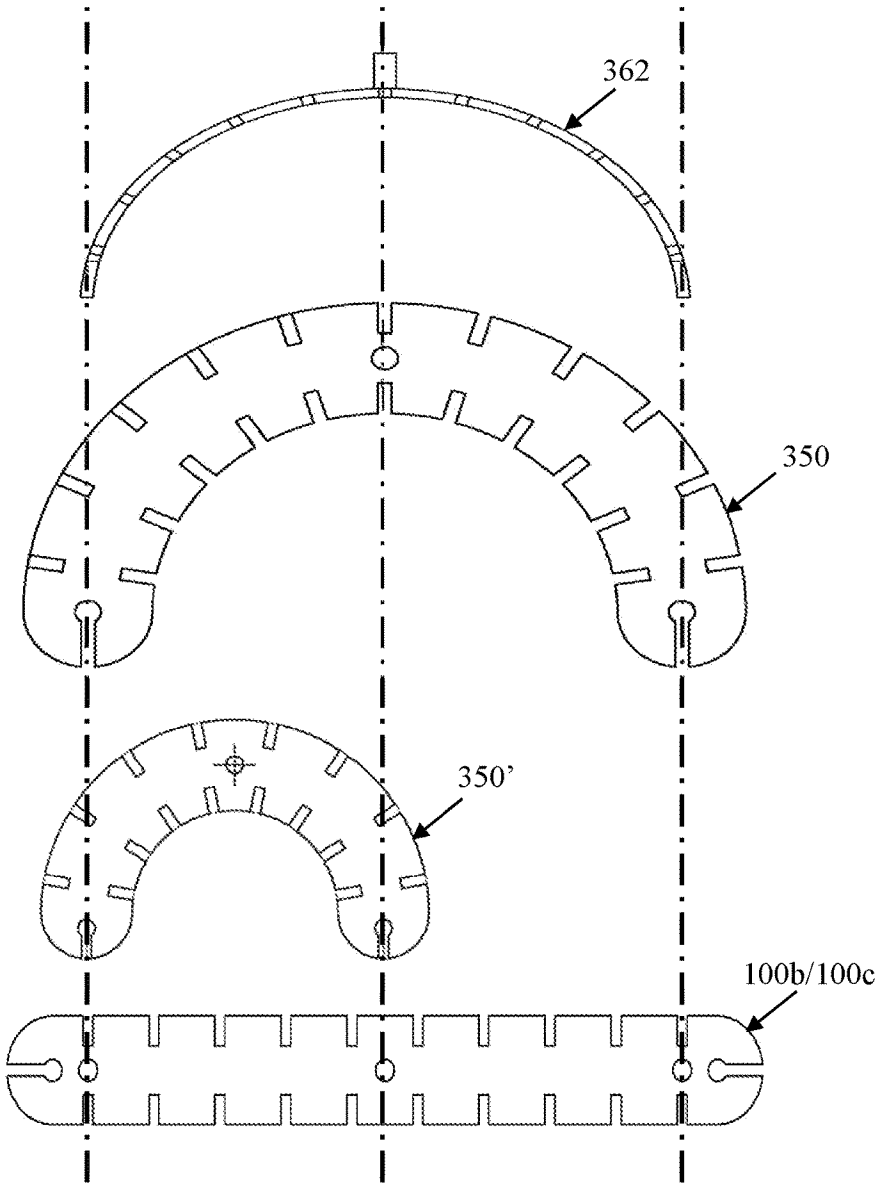

FIGS. 12*a* and 12*b* illustrate preferred proportional symmetry among members of non-limiting example groups of selected assembly pieces.

It should be appreciated that the proportional symmetry provides the construction toy system with the required modularity. As exemplified in the figures, the modular assembly pieces shown are predesigned to have a proportional symmetry therebetween the assembly pieces, wherein the lengths of the respective assembly pieces are either the same or multiplied by an integer. More so, the modular assembly pieces are predesigned to have a proportional symmetry therebetween the distances between respective adjacent circular through hole (103, 110) formed in the respective assembly pieces is either the same or multiplied by an integer. It should be further appreciated that the modularity of construction toy system also facilitated the assembly of complex structures utilizing the modular assembly pieces of the present disclosure.

In both example figures (FIG. 12*a*) the selected pieces are compared in length with a basic flat-stick piece type 100, in this example basic flat-stick piece type 100*b* type 100*c*. In this non limiting example, the distance factor between adjacent said circular through holes is 1:2, that is, for example two flat U-shaped pieces can be placed, side-by-side, on top of a single basic flat-stick piece 100. In other example groups of assembly pieces (FIG. 12*b*), while a single flat bow-shaped piece 350 can be placed on top of a single basic flat-stick piece 100, two half-form flat bow-shaped pieces 350' (see FIG. 12*b*) can be placed on top of a single basic flat-stick piece 100. It should be appreciated that other integer distance factors may be used.

Figures 13A, 13B:
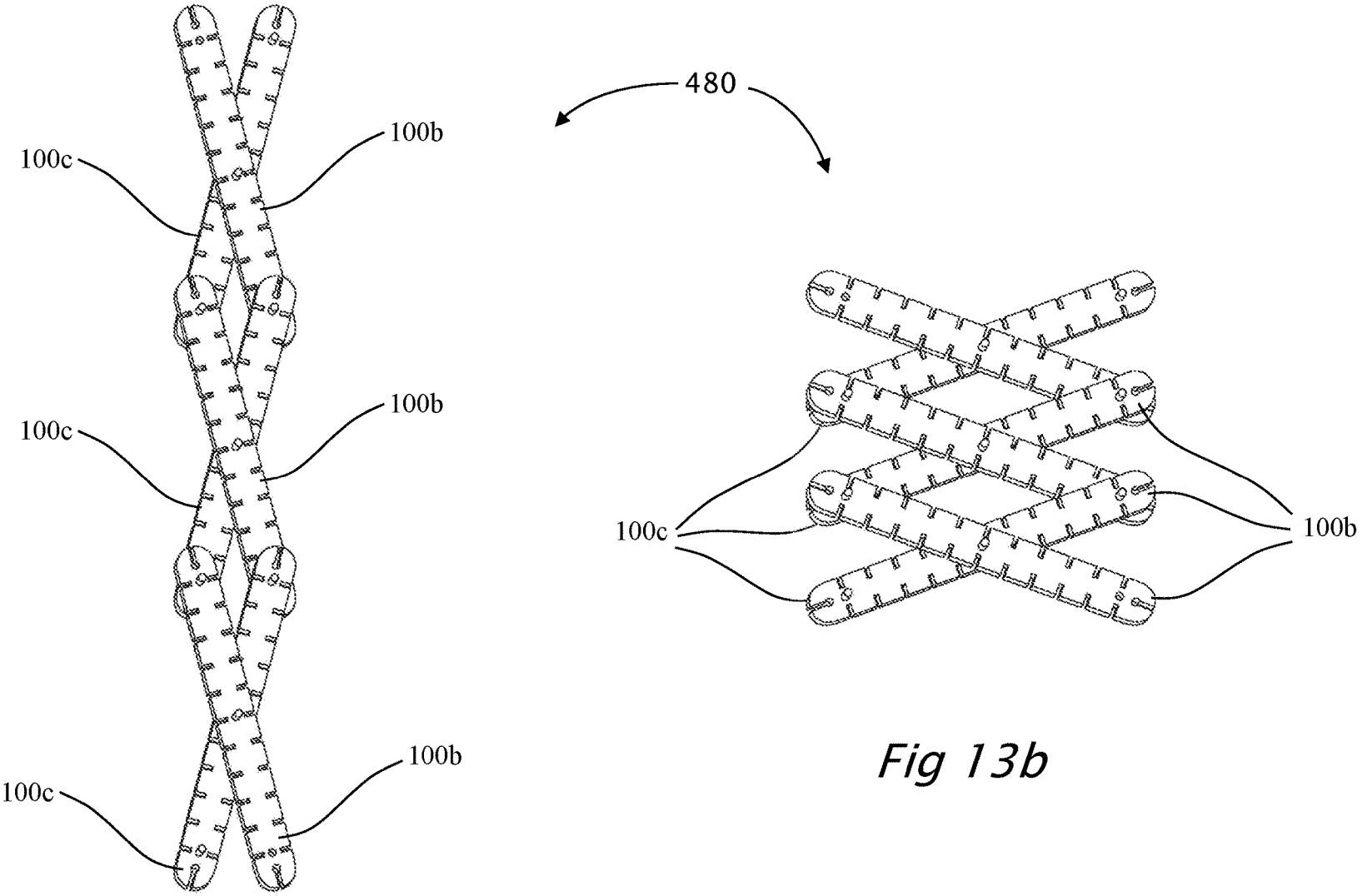
FIG. 13*a* is a perspective view illustration of an example of three pairs of second and third basic flat-sticks, interconnected at the ends to facilitate scissors motion, according to variations of the present disclosure, wherein the scissors structure is shown in an elongated stretched position.
FIG. 13*b* is a perspective view illustration of an example of three pairs of second and third basic flat-sticks, interconnected at the ends to facilitate scissors motion, according to variations of the present disclosure, wherein the scissors structure is shown in a broad contracted position.

FIG. 13*a* is a perspective view illustration of an example of three pairs of second (100*b*) and third (100*c*) basic flat-sticks, interconnected at the ends to facilitate scissors motion, according to variations of the present disclosure, wherein a scissors structure 480 is shown in an elongated stretched position. FIG. 13*b* illustrates the example of three pairs of second (100*b*) and third (100*c*) basic flat-sticks, wherein the scissors' structure 480 is shown in a broad contracted position. It should be appreciated that the scissors' structure and motion is facilitated by the modularity of the construction toy system.

Figure 14B:
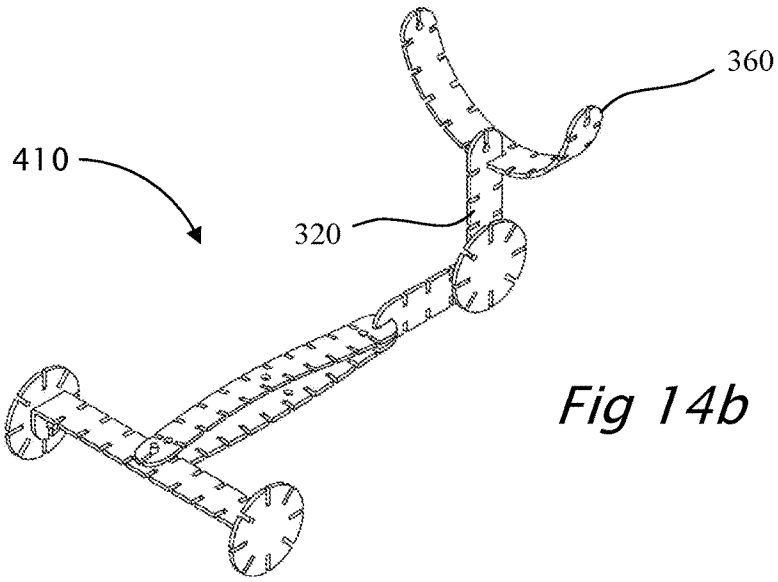
FIG. 14*b* is a perspective view illustration showing another example embodiment of a construction in a form of a tri-wheels scooter, wherein the elongate body is using a pair of second and third basic flat-sticks that are slightly bent.
Figure 14C:
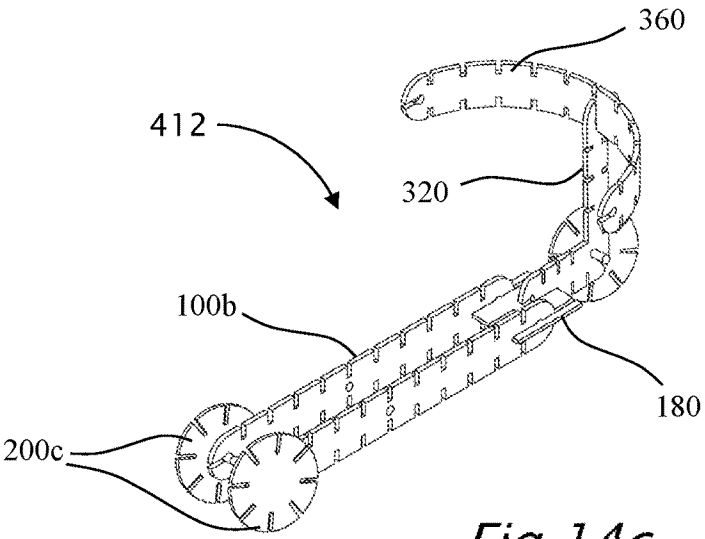
FIG. 14*c* is a perspective view illustration showing another example embodiment of a construction in a form of another tri-wheels scooter.
Figure 14A:
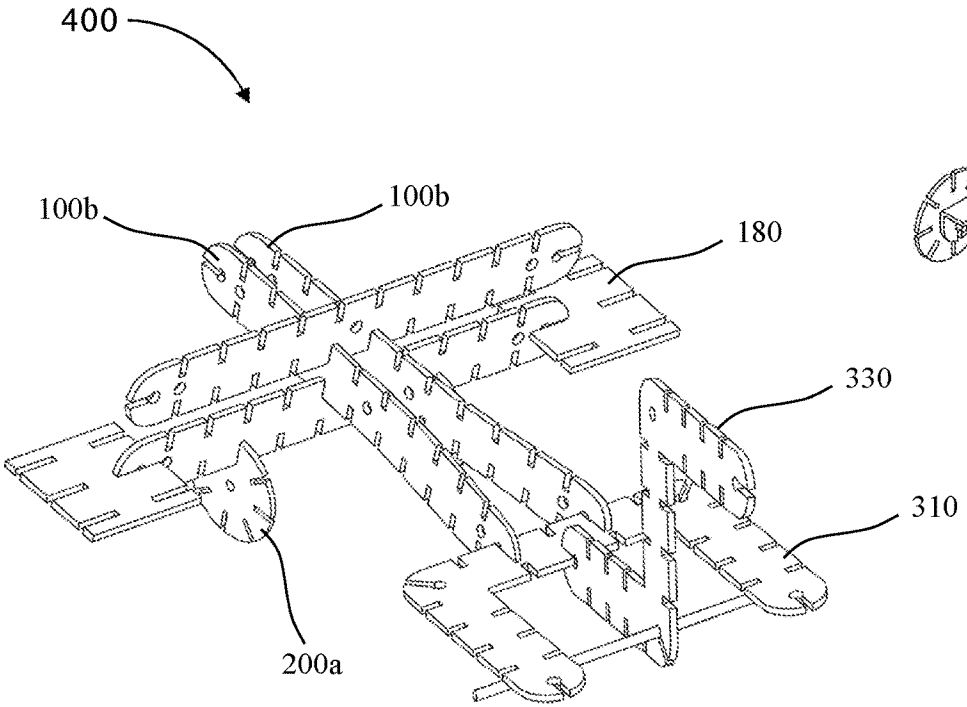
FIG. 14*a* is a perspective view illustration showing an example embodiment of a construction in a form of an aircraft, according to variations of the present disclosure, wherein the elongate body is using second basic flat-sticks that are slightly bent.

FIG. 14*a* is a perspective view illustration showing an example embodiment of a construction 400 in a form of an aircraft, according to variations of the present disclosure, wherein the elongate body is using second basic flat-sticks 100*b* that are slightly bent, to demonstrate the resiliency of the materials from which the game assembly pieces are preferably made of.

FIG. 14*b* is a perspective view illustration showing another example embodiment of a construction 410 in a form of a tri-wheels scooter, wherein the elongate body is using a pair of second (100*b*) and third (100*c*) basic flat-sticks that are slightly bent. FIG. 14*c* is a perspective view illustration showing another example embodiment of a construction 412 in a form of another tri-wheels scooter.

Figure 15:
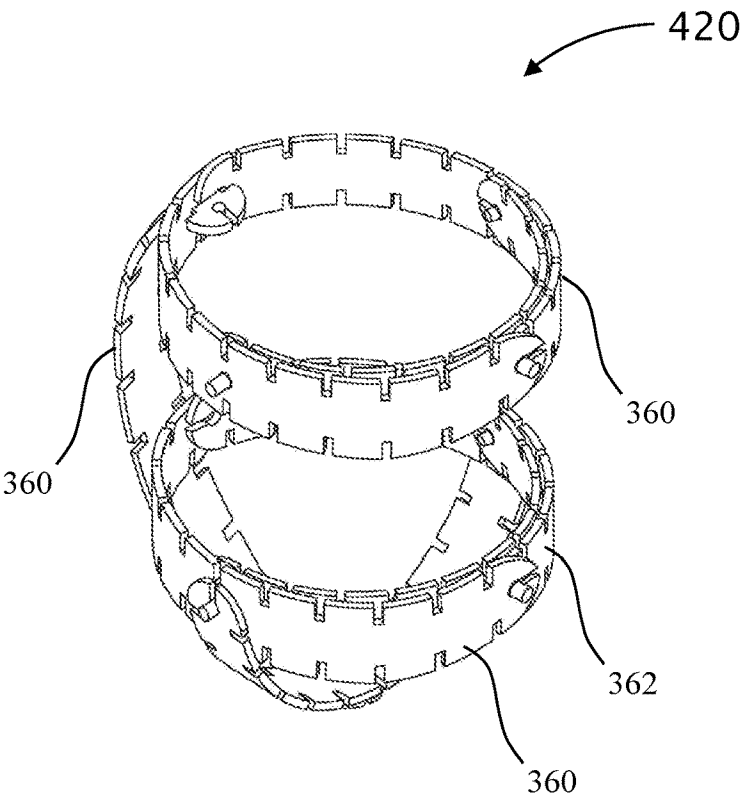
FIG. 15 is a perspective view illustration showing another example embodiment of a construction, using a number of example upright bow-shaped pieces as shown in FIGS. 10*b* and 10*c*.

FIG. 15 is a perspective view illustration showing another example embodiment of a construction 420, using a number of example upright bow-shaped pieces 360 and 362.

Figure 16:
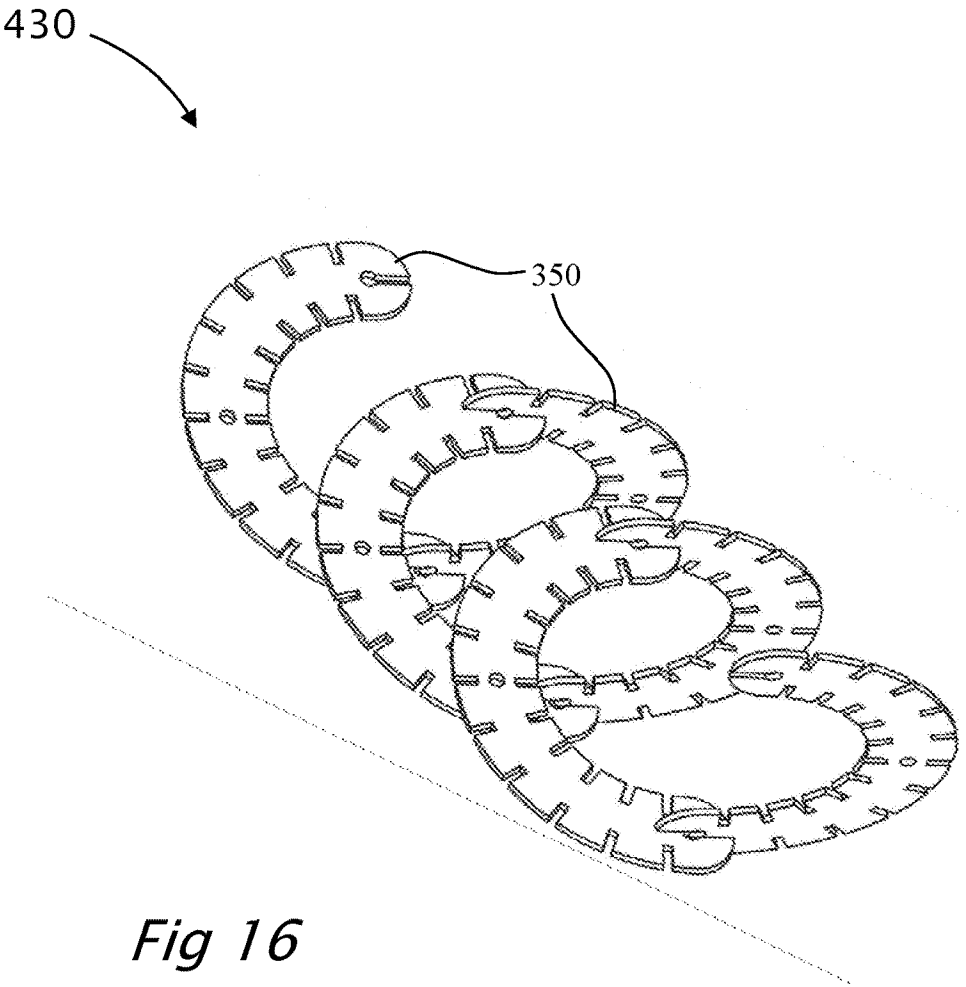
FIG. 16 is a perspective view illustration showing another example embodiment of a construction, using a number of example upright bow-shaped pieces as shown in FIG. 10*a*.

FIG. 16 is a perspective view illustration showing another example embodiment of a helical construction 430, using a number of example upright bow-shaped pieces 350.

Figure 17:
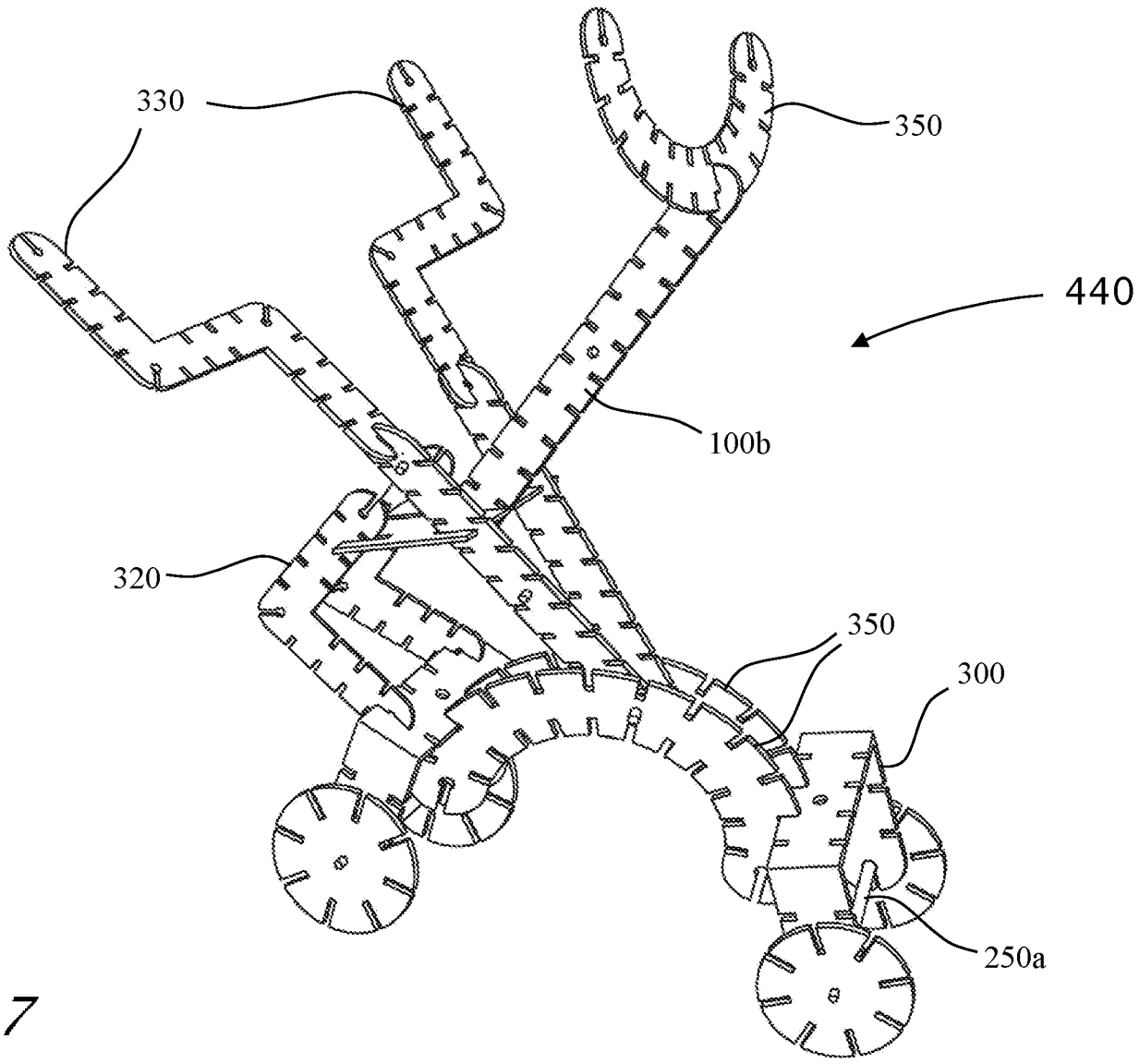
FIG. 17 is a perspective view illustration showing another example embodiment of another example construction.

FIG. 17 is a perspective view illustration showing another example embodiment of another example construction 440. It should be appreciated the set of game assembly pieces of the present disclosure allows myriads of construction possibilities.

Figure 18:
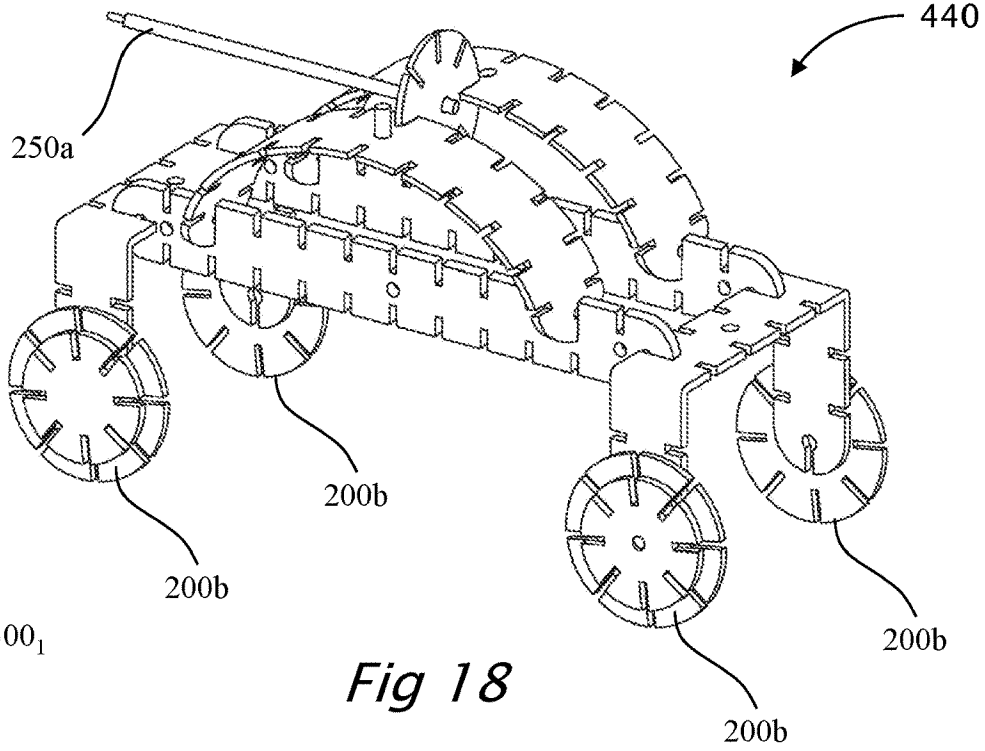
FIG. 18 is a perspective view illustration showing another example embodiment of a construction, simulation a 4-wheels cannon.

FIG. 18 is a perspective view illustration showing another example embodiment of a construction 440, simulation a 4-wheels cannon.

Figure 19:
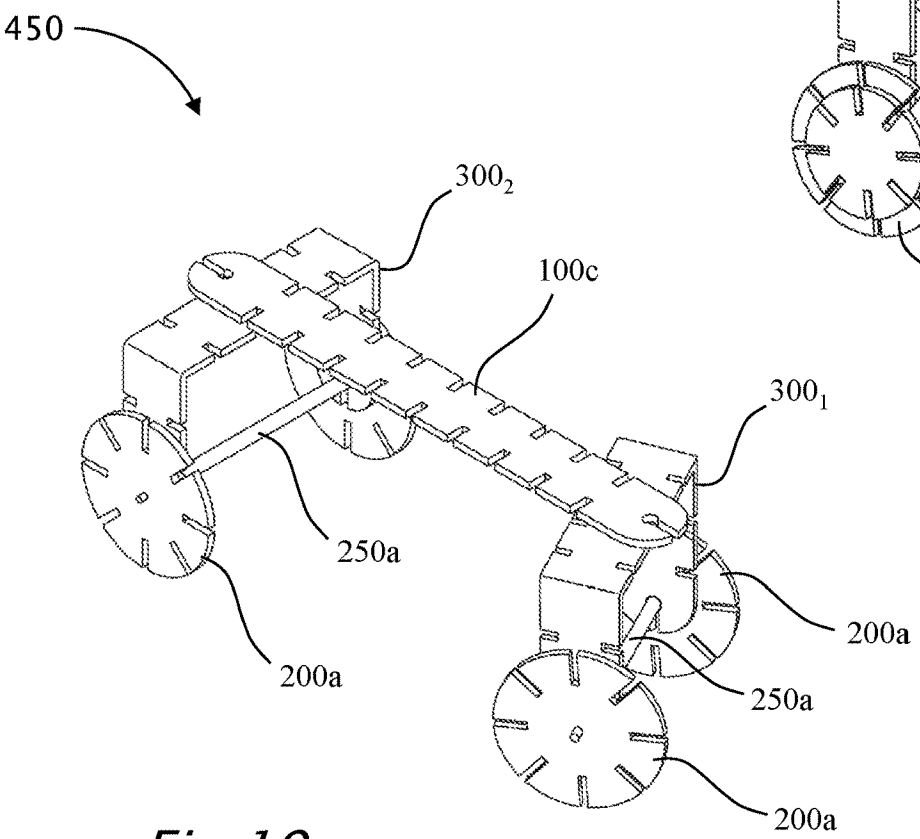
FIG. 19 is a perspective view illustration showing another example embodiment of a construction, simulation a 4-wheels wagon, wherein each pair of wheels (front and rear) can rotate 360 degrees.

FIG. 19 is a perspective view illustration showing another example embodiment of a construction 450, simulation a 4-wheels wagon. The 4-wheels wagon 450 includes: a front pair of wheels 200*a* interconnected by a pivotal-rod piece 250*a*, wherein a narrow upright U-shaped piece $\mathbf{300}_1$ is mounted onto the pivotal-rod piece 250*a*; a rear pair of wheels 200*a* interconnected by another pivotal-rod piece 250*a*, wherein a narrow upright U-shaped piece $\mathbf{300}_2$ is mounted onto the other pivotal-rod piece 250*a*; and a third (100*c*) basic flat-stick that pivotally interconnects the two pair of narrow upright U-shaped piece (front $\mathbf{300}_1$ and rear $300_2$) wherein each pair of narrow upright U-shaped piece (front $300_1$ and rear $300_2$) can rotate 360 degrees about each other.

Figure 20B:
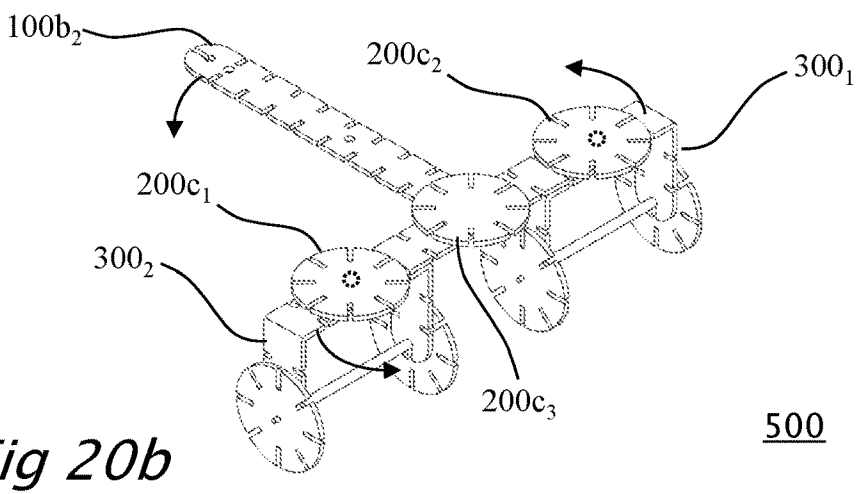
FIGS. 20*a*-20*d* illustrate a 4-wheels wagon similar to the 4-wheels wagon shown in FIG. 18 with additional pointing parts, showing the wagon in four different positions.
Figure 20C:
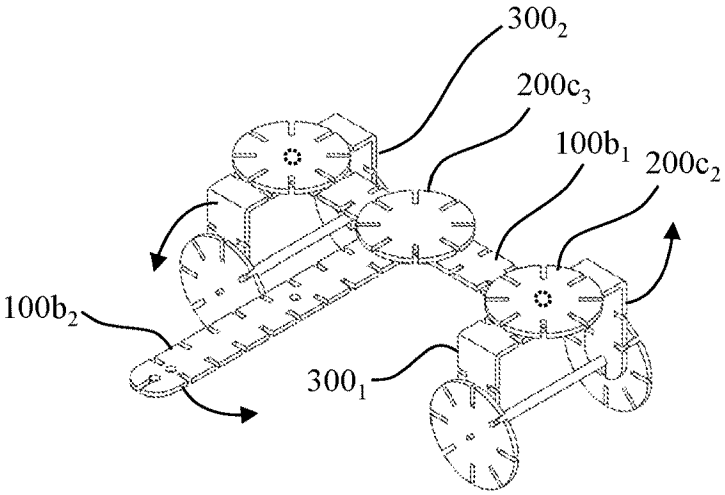
Figure 20A:
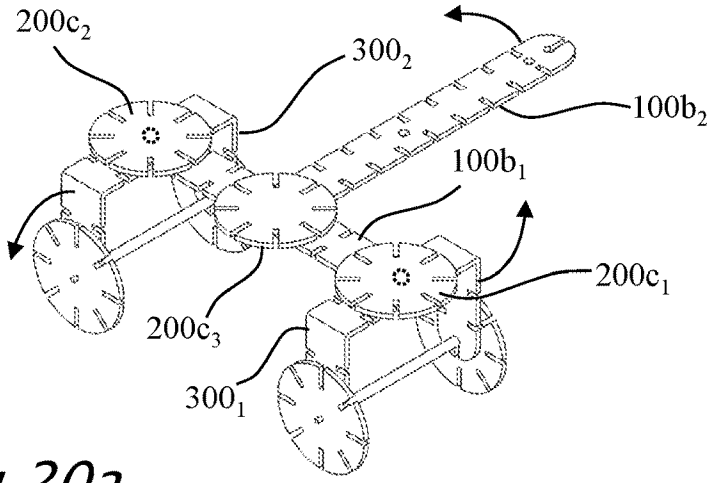
Figure 20D:
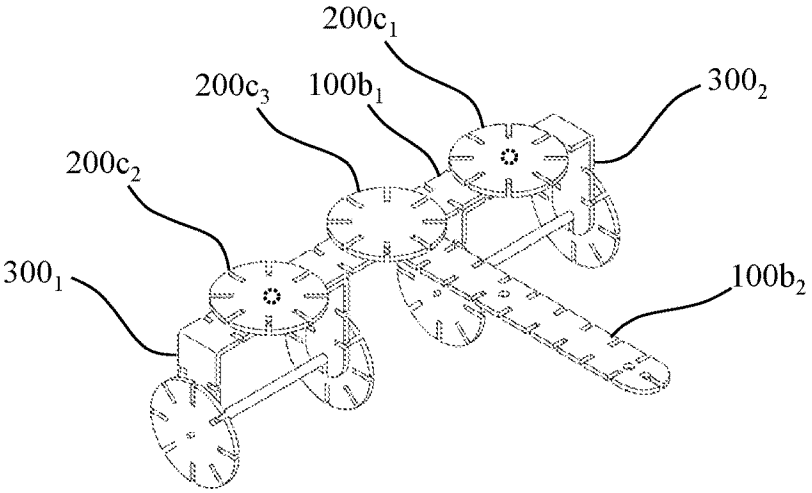

FIGS. 20*a*-20*d* illustrate a 4-wheels wagon 500 similar to the 4-wheels wagon 450 but with additional parts: showing the wagon in four different positions: an initial tandem position (FIG. 20*a*), a first intermediate side-by-side position (FIG. 20*b*), a second intermediate tandem position (FIG. 20*c*), and an end side-by-side position (FIG. 20*d*). The third (100*c*) basic flat-stick is replaced by a second-basic flat-stick $100b_1$, and another second-basic flat-stick 100*b*, being a pointer flat-stick $100b_2$. The rotational abilities of 4-wheels wagon 500 are respectively provided by three pivotal connecting flat wheel pieces 200*c*: wheel piece $200c_1$ provides rotational abilities to narrow upright U-shaped piece $300_1$, wheel piece $200c_2$ provides rotational abilities to narrow upright U-shaped piece $300_2$, and wheel piece $200c_3$ simply attaches pointer flat-stick $100b_2$ to basic flat-stick $100b_1$. Pointer flat-stick $100b_2$ indicates the rotation state. It should be appreciated that the motion of 4-wheels wagon 500 is facilitated by the modularity of the construction toy system.

As the front upright U-shaped piece $300_1$ is moved counterclockwise, second-basic flat-stick $100b_1$ rotates about narrow upright U-shaped piece $300_2$ (that in this non-limiting example stands still) utilizing wheel piece $200c_2$. As second-basic flat-stick $100b_1$ completes 90° of rotation, the 4-wheels wagon 500 reaches the first intermediate side-by-side position of the two sets of wheels, as shown in FIG. 20*b*. Similarly, as second-basic flat-stick $100b_1$ continuous to rotate about narrow upright U-shaped piece $300_2$, the 4-wheels wagon 500 reaches the second intermediate tandem position of the two sets of wheels, as shown in FIG. 20*c*, and then to the end side-by-side position, as shown in FIG. 20*d*.

Figure 21A:
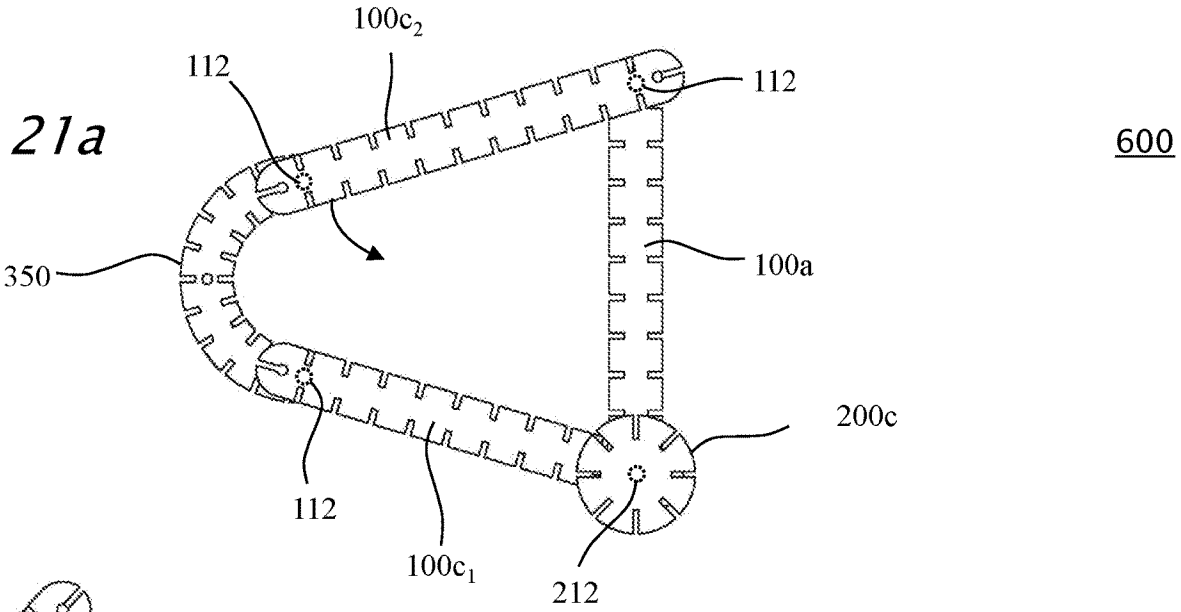
Figure 21C:
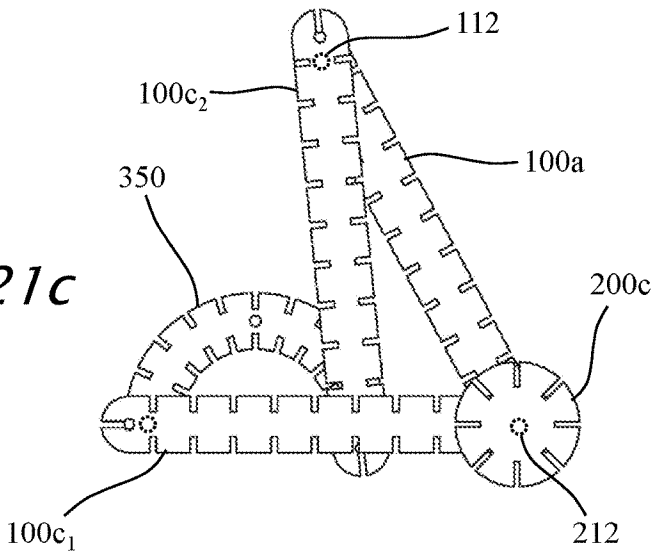
Figure 21B:
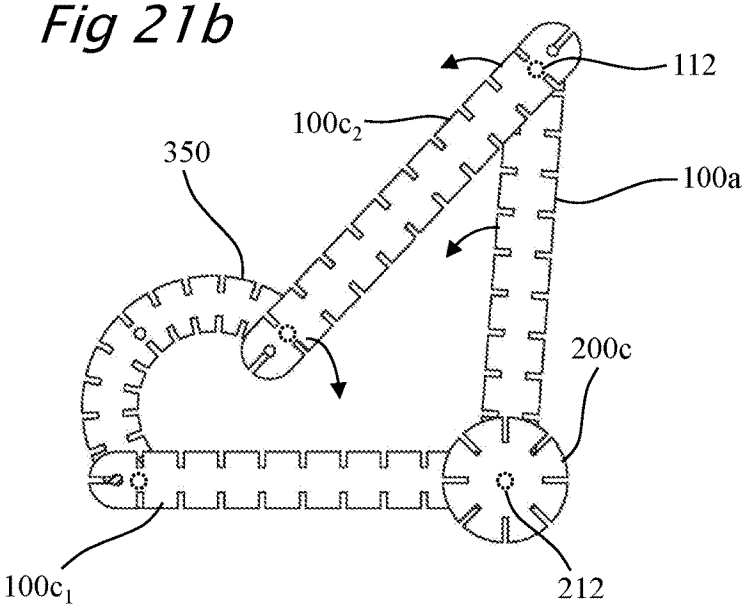

FIGS. 21*a*-21*c* illustrate another example embodiment of another example structure 600 having moving parts, in three different positions: an initial position (FIG. 21*a*), an intermediate position (FIG. 21*b*), and an end position (FIG. 21*c*). Structure 600 includes a flat wheel piece 200*c* that has a cylindrical peg 212 protruding at the center of the wheel (the peg is hidden in this view), a first basic flat-stick piece 100*a*, two third basic flat-stick pieces 100*c* and a flat bow-shaped piece 350. The flat bow-shaped piece 350 is connected at one end to via a first circular through hole 103 to an end cylindrical peg 112 of one flat-stick piece $100c_1$ and the second end of flat bow-shaped piece 350 is connected via the second circular through hole 103 of the flat bow-shaped piece 350 to a cylindrical peg 112 of the second flat-stick piece $100c_2$. The first flat-stick piece $100c_1$ is connected (not visible in the figures) via an end hole through hole 103 to the cylindrical peg 212 of flat wheel piece 200*c*; and the second flat-stick piece $100c_2$. The first flat-stick piece $100c_1$ is connected via an end cylindrical peg 112 being rotatably inserted to a circular through hole 103 of the first basic flat-stick piece 100*a*. The other end of first basic flat-stick piece 100*a* is connected (also not visible in the figures) via the other circular through hole 103 to the cylindrical peg 212 of flat wheel piece 200*c*. It should be appreciated that the motion of structure 600 is facilitated by the modularity of the construction toy system.

It should be appreciated that a variety of connectors may be used Embodiments, however, are not limited to the disclosed set of game assembly pieces, and may encompass other shapes that fall within the spirit and scope of the principles of this disclosure. Each game assembly piece may be provided with a color and may be composed of any suitable material that will fall within the spirit and scope of the principles of this disclosure.

The present invention being thus described in terms of several embodiments and examples, it will be appreciated that the same may be varied in many ways. Such variations are not to be regarded as a departure from the spirit and scope of the invention, and all such modifications as would be obvious to one skilled in the art are contemplated.

The invention claimed is:

1. A modular construction toy system, comprising:

a plurality of toy assembly pieces and a plurality of pivotal-rods, at least a first of said pivotal-rods comprises an elongated cylindrically shaped central member and an engaging rod-tip extended away from the elongated cylindrically shaped central member, the engaging rod-tip comprising a diameter smaller than a diameter of the elongated cylindrically shaped central member; and at least a second of said pivotal-rods comprise a matching receiving cavity at each end of said central member configured to receive the engaging rod-tip; and each of said toy assembly pieces comprises identical thickness and a circumferential edge, wherein a plurality of straight receiving grooves are formed, inwardly, at said circumferential edge, and wherein said identical thickness is configured to fittingly fill the gap formed by said straight receiving groove, wherein a selected toy assembly piece of said plurality of toy assembly pieces is configured to interlock with another toy assembly piece via respectively selected straight receiving grooves of both selected toy assembly pieces;

wherein at least one of said plurality of toy assembly pieces is a flat-stick piece comprising modularly connectable toy assembly pieces having at least one pair of through holes formed inside each of said modularly connectable toy assembly pieces, a pair of elongated flat faces, an elongated body with two elongated parallel edges, a longitudinal axis, and rounded ends having a respective straight end-groove formed with said through hole, said flat-stick piece comprises one or more pegs formed therewith and protruding outwardly perpendicularly to one of the two faces of said flat-stick piece or outwardly perpendicularly away from one or more straight elongated parallel edges of said flat-stick piece, along said longitudinal axis, wherein said pair of through holes formed inside each of said modularly connectable toy assembly pieces have a unified dimension, wherein said at least one pair of through holes are spaced apart by either a same distance, or by that a distance multiplied by an integer, and wherein said same distance of said pair of through holes renders the construction toy system to be modular; and wherein a selected engaging rod-tip is configured to either fittingly interlock with another pivotal-rod via a respectively selected receiving cavity, or with a selected toy assembly piece via a respectively selected fitted through hole formed in said selected toy assembly piece.

2. The modular construction toy system of claim 1, wherein said circumferential edge is a circular edge.

3. The modular construction toy system of claim 2, wherein at least one of said plurality of toy assembly pieces is a flat, ring-shaped piece.

4. The modular construction toy system of claim 2, wherein at least one of said plurality of toy assembly pieces is a flat, oval shaped piece.

5. The modular construction toy system of claim 1, wherein said flat-stick piece comprises the pair of elongated flat faces, and wherein each of said end-grooves ends with said end-through hole.

6. The modular construction toy system of claim 5, wherein said flat-stick piece further includes connecting pegs that are protruding perpendicularly away from said one or more straight elongated parallel edges of said flat-stick piece.

7. The modular construction toy system of claim 5, wherein at least one of said plurality of toy assembly pieces is a flat, right angle U-shaped piece.

8. The modular construction toy system of claim 5, wherein at least one of said plurality of toy assembly pieces is an upright, right angle U-shaped piece.

9. The modular construction toy system of claim 5, wherein at least one of said plurality of toy assembly pieces is a flat, L-shaped piece.

10. The modular construction toy system of claim 5, wherein at least one of said plurality of toy assembly pieces is a flat, traversed-Z-shaped piece.

11. The modular construction toy system of claim 5, wherein at least one of said plurality of toy assembly pieces is an upright, traversed-T-shaped piece.

12. The modular construction toy system of claim 5, wherein at least one of said plurality of toy assembly pieces is a flat, bow-shaped piece.

13. The modular construction toy system of claim 1, wherein one or more of said toy assembly pieces have at least one enclosed through hole that is formed at a central location with respect to the lateral dimension of said toy assembly pieces, and wherein a selected pivotal-rod of said pivotal-rods is also configured to interlock with a selected toy assembly piece by engaging a selected engaging rod-tip of said selected pivotal-rod with a selected enclosed through hole of said selected toy assembly piece.

14. The modular construction toy system of claim 1, wherein at least one of said toy assembly pieces has at least one connecting peg that is protruding from said at least one toy assembly piece, and wherein said at least one connecting peg is configured to fittingly interlock with a selected through hole of another selected toy assembly piece.

15. The modular construction toy system of claim 14, wherein said connecting peg is configured to fittingly interlock with a selected pivotal-rod by engaging said connecting peg with said receiving cavity of said selected pivotal-rod.

16. The modular construction toy system of claim 1, wherein said plurality of toy assembly pieces are selected from a group of toy assembly pieces including a flat-stick piece, a connector-piece, a flat wheel piece, a flat U-shaped piece, a narrow upright U-shaped piece, a wide upright U-shaped piece, a flat L-shaped piece, a flat traversed-Z-shaped piece, an upright T-shaped piece, a flat bow-shaped piece, an upright bow-shaped piece, a flat ring-shaped piece, a flat oval-shaped piece, an upright ring-shaped piece and an upright oval-shaped piece.

* * * * *